US010549139B2

(12) United States Patent
Zanyk

(10) Patent No.: US 10,549,139 B2
(45) Date of Patent: Feb. 4, 2020

(54) ISOMETRIC EXERCISE AND STRETCHING APPARATUS

(71) Applicant: Marien Zanyk, South Glastonbury, CT (US)

(72) Inventor: Marien Zanyk, South Glastonbury, CT (US)

(73) Assignee: W2Designs LLC, South Glastonbury, CT (US)

( * ) Notice: Subject to any disclaimer, the term of this patent is extended or adjusted under 35 U.S.C. 154(b) by 538 days.

(21) Appl. No.: 15/115,412

(22) PCT Filed: Feb. 25, 2015

(86) PCT No.: PCT/US2015/017517

§ 371 (c)(1),
(2) Date: Jul. 29, 2016

(87) PCT Pub. No.: WO2015/130779

PCT Pub. Date: Sep. 3, 2015

(65) Prior Publication Data

US 2017/0001056 A1 Jan. 5, 2017

Related U.S. Application Data

(60) Provisional application No. 61/944,242, filed on Feb. 25, 2014.

(51) Int. Cl.
*A63B 21/002* (2006.01)
*A63B 21/068* (2006.01)
(Continued)

(52) U.S. Cl.
CPC .... *A63B 21/0023* (2013.01); *A63B 21/00047* (2013.01); *A63B 21/068* (2013.01);
(Continued)

(58) Field of Classification Search
CPC ..... A63B 21/0023; A63B 21/00047; A63B 21/068; A63B 23/0211; A63B 23/0216;
(Continued)

(56) References Cited

U.S. PATENT DOCUMENTS 581,835 A 5/1897 Sturgis
3,708,167 A 1/1973 Potgieter
(Continued)

FOREIGN PATENT DOCUMENTS

KR 10-1999-0022456 A 3/1999
RU 2411896 C1 2/2011
(Continued)

OTHER PUBLICATIONS

Written Opinion for International Application No. PCT/US2015/017517 dated Jul. 28, 2015.
(Continued)

*Primary Examiner* — Rafael A Ortiz
(74) *Attorney, Agent, or Firm* — Lathrop Gage LLP

(57) ABSTRACT

Apparatus for physical exercise comprises a central post (which may be triangular tubular in cross-section, formed by the three walls); at least three roots protruding generally horizontally in differing directions from the base of the post; and at least three branches that protrude generally horizontally from the post at differing heights and in differing directions, wherein the at least three branches are composed of fibrous material with the fibers oriented generally along the lengths of the branches.

9 Claims, 35 Drawing Sheets

(51) Int. Cl.

| | |
|---|---|
| ***A63B 21/00*** | (2006.01) |
| ***A63B 23/02*** | (2006.01) |
| ***B65D 85/00*** | (2006.01) |
| *A63B 23/00* | (2006.01) |

(52) U.S. Cl.
CPC ..... *A63B 21/4035* (2015.10); *A63B 23/0233* (2013.01); *B65D 85/70* (2013.01); *A63B 2023/006* (2013.01); *A63B 2210/50* (2013.01)

(58) Field of Classification Search
CPC .. A63B 21/002; A63B 23/0233; A63B 26/003
USPC ..... 482/33, 91, 92, 129–131, 907
See application file for complete search history.

(56) References Cited

U.S. PATENT DOCUMENTS

| | | | | |
|---|---|---|---|---|
| 3,871,648 | A | 3/1975 | Maurer, III | |
| 3,905,597 | A | 9/1975 | Tabb | |
| 3,958,801 | A | 5/1976 | Correa | |
| D242,731 | S | 12/1976 | Taylor | |
| 4,082,265 | A | 4/1978 | Berkes | |
| 4,415,150 | A | 11/1983 | Iezza | |
| D280,225 | S | 8/1985 | Eagle | |
| 4,620,701 | A | 11/1986 | Mojden | |
| 4,620,704 | A | 11/1986 | Shifferaw | |
| D290,033 | S | 5/1987 | Policastro | |
| 4,902,000 | A | 2/1990 | Starks et al. | |
| 4,927,138 | A | 5/1990 | Ferrari | |
| 5,232,423 | A | 8/1993 | Hajduczek | |
| 5,344,372 | A | 9/1994 | Hung | |
| D363,902 | S | 11/1995 | Wright | |
| D377,507 | S | 1/1997 | Thomas, Sr. | |
| 5,662,560 | A | 9/1997 | Svendsen et al. | |
| D390,500 | S | 2/1998 | Walker | |
| 6,030,301 | A | 2/2000 | Asada et al. | |
| 6,129,651 | A | 10/2000 | Denaro | |
| 6,168,548 | B1 | 1/2001 | Fleming | |
| 6,270,448 | B1 | 8/2001 | Smith | |
| 6,450,923 | B1 | 9/2002 | Vatti | |
| 6,520,891 | B1 | 2/2003 | Stephens, Jr. | |
| D478,954 | S | 8/2003 | Forrest | |
| D522,933 | S | 6/2006 | Monaghan | |
| D562,417 | S | 2/2008 | Noojin | |
| D606,611 | S | 12/2009 | Rogers et al. | |
| 7,662,071 | B2 | 2/2010 | Ditolla | |
| 7,713,175 | B2 | 5/2010 | Monaghan | |
| D617,407 | S | 6/2010 | Ruiz | |
| 8,585,559 | B1 | 11/2013 | Shannon | |
| D695,856 | S | 12/2013 | Jacobs et al. | |
| 8,617,007 | B2 | 12/2013 | Gilman | |
| 8,758,277 | B2 * | 6/2014 | Rathi | A61B 5/11 482/138 |
| 8,858,405 | B2 | 10/2014 | Agate | |
| D731,005 | S | 6/2015 | Pierroz | |
| D732,612 | S | 6/2015 | Klampfer | |
| D745,939 | S * | 12/2015 | Kaye | D21/686 |
| 9,283,460 | B1 | 3/2016 | Viera | |
| 9,295,894 | B2 | 3/2016 | Papadopolous | |
| 9,737,751 | B2 * | 8/2017 | Anderson | A63B 21/16 |
| 2004/0009853 | A1 * | 1/2004 | Smith | A63B 17/04 482/91 |
| 2005/0272567 | A1 | 12/2005 | Ditolla | |
| 2006/0058158 | A1 * | 3/2006 | McAvoy | A63B 1/00 482/38 |
| 2008/0113852 | A1 * | 5/2008 | Caldwell | A63B 21/00047 482/133 |
| 2008/0254950 | A1 * | 10/2008 | Beliles | A63B 69/004 482/83 |
| 2008/0312009 | A1 | 12/2008 | Gilman | |
| 2011/0124474 | A1 | 5/2011 | Gilman | |
| 2011/0224050 | A1 | 9/2011 | Larish | |
| 2014/0073491 | A1 | 3/2014 | Gilson | |
| 2014/0274607 | A1 * | 9/2014 | Kaye | A63B 21/0557 482/130 |
| 2015/0126348 | A1 * | 5/2015 | Kaye | A63B 21/0442 482/130 |
| 2015/0231475 | A1 | 8/2015 | Tompkins et al. | |

FOREIGN PATENT DOCUMENTS

| | | | |
|---|---|---|---|
| SU | 1757690 | A1 | 8/1992 |
| UA | 18186 | A | 10/1997 |
| WO | 98/26843 | A1 | 6/1998 |

OTHER PUBLICATIONS

Extended European Search Report for EP Application No. 15 756 059.0 dated Nov. 3, 2017.

Australian Examination Report for related Australian Application No. 2015223105 dated Feb. 9, 2017.

International Search Report for PCT/US2015/017517 dated Aug. 20, 2015.

* cited by examiner

ISOMETRIC EXERCISE AND STRETCHING APPARATUS

CROSS-REFERENCE TO RELATED APPLICATIONS

This application claims priority to International Application Serial No. PCT/US2015/017517, filed Feb. 25, 2015, which claims the benefit of U.S. Provisional Patent Application No. 61/944,242, filed Feb. 25, 2014, the disclosures of which are hereby incorporated by reference herein in their entireties.

BACKGROUND

Technical Field

The invention relates to exercise equipment, and, more particularly, to isometric workout apparatus.

Description of Art

Workout apparatus, intended to utilize one's body weight as the primary muscle load, has been well known. Examples include chin up and dip bars, roman chairs, and the like. Stretching machines, for example as shown in U.S. Pat. No. 5,100,131 "Back muscle exercising and stretching apparatus," also are known. Moreover, isometric apparatus such as shown in U.S. Pat. 4,620,704 "Universal exercising machine," also are known.

Resistance training is based on the principle that muscles of the body will work to overcome the resistance force when required to do so. A resistance load leads to increased skeletal muscle strength, anaerobic endurance and size. When stressed to maximum load, the phenomenon of 'neural adaptation' and 'muscle hypertrophy', in which the nerve/muscle motor units fire more frequently, increase in number and enlarge the tissue, ensures that the muscle builds strength. The muscle needs only to be contracted to the point of fatigue by repetition (2-3 sets of 6-12) at its own matched force. Therefore the load, to be effective, only needs to be as great as a person's contracted force.

In general, the present option of resistance training is by way of body weight training or by using bulky sets of free weights, massive systems of pulleys, hard metal power structures, Thera-bands or expensive and time consuming trips to the gym. These available systems are often not conducive to home use as they are perceived as cumbersome, non affordable and undesirable by many home users. It would therefore be desirable to have an effective, all encompassing workout system; one which is compact, affordable, esthetically pleasing and highly effective in strengthening and stretching soft tissues in an unlimited array of user directed positions.

Body-weight training is convenient and free; it is also the preferred method of exercise for many. However, because an 'unassisted' individual will quickly lose their balance due to joint instability of the knees and ankles, their attempt at upright body weight-based exercise cannot be achieved. Without support, it is extremely difficult, if not physically impossible to maintain balance; most people cannot balance on one foot for more than a few seconds while exercising the opposite limb or joint. The impairment of balance, strength and stability prevents the ease of upright body weight-resistance training. Whether to strengthen or stretch muscles, ligaments, tendons, nerves, joint capsules or restrictive scar tissue, the necessary positions cannot be accomplished without support.

BRIEF DESCRIPTION

Aspects of the invention combine the functionality and structural features of stretching machines with those of isometric and bodyweight workout apparatus.

The unique limbs of a willow workout device, according to the invention, provide responsive resistance training through a 'push back' force which matches one's forced output. In addition, its design provides controlled balance for 'isolated' body-weight resistance training. Finally, with its numerous position options for body stretch, this device provides exceptional, stabilized soft tissue stretch. Thus, the willow workout device satisfies these requirements as a novel home exercise device designed of 'responsive' wooden limbs, built into a structural design which enables progressive routines in strength, balance and flexibility. The willow workout device is unique in its concept, including composition of natural wood lamination to provide responsive 'push back' resistance to one's exerted force and its interactive design of 'limbs' and handholds, which satisfy the need for aggressive positioning to effectively advance muscle strength and soft tissue flexibility. Combinations of strength, flexibility and balance training are provided within this novel form of workout and are applicable to both the exercise and rehabilitation populations. In addition to its ease of use, level of enjoyment, affordability and natural beauty, the willow workout provides a unique method of balanced, resistance training for universal use.

Thus, embodiments of the invention provide apparatus for physical exercise. The apparatus comprises a central post (which may be triangular tubular in cross-section, formed by the three walls); at least three roots protruding generally horizontally in differing directions from the base of the post; and at least three branches that protrude generally horizontally from the post at differing heights and in differing directions, wherein the at least three branches are composed of fibrous material with the fibers oriented generally along the lengths of the branches.

Other embodiments provide a shipping carton, which contains a post that is packaged along with at least three limbs. Each of the limbs, comprises a stem with first and second ends, at least one branch protruding from the first end of the stem, and a root protruding from the second end of the stem. The shipping carton also contains fasteners for attaching the at least three limbs to the post. The post includes preformed sites for installation of the fasteners to attach the at least three limbs; the stems of the at least three limbs include preformed holes for installation of the fasteners; and the preformed sites are distributed about the post and the preformed holes are disposed in the stems of the at least three limbs, in such a manner that the limbs when attached to the post have their at least three roots protruding in differing directions from a base of the post to support the post in an upright position, and have their at least three branches protruding in differing directions and at differing heights from the post.

Embodiments of the invention enable modes of physical exercise that include approaching an apparatus; engaging one's first appendage with a first branch of the apparatus; exerting at least a portion of one's body weight onto the first branch of the apparatus via one's first appendage; and adjusting a position of one's first appendage along the first branch of the apparatus, in order to obtain a desired range of movement of one's first appendage.

DESCRIPTION OF DRAWINGS

An exemplary embodiment of the invention, as briefly described above, is illustrated by certain of the following figures.

DETAILED DESCRIPTION

Figure 1:
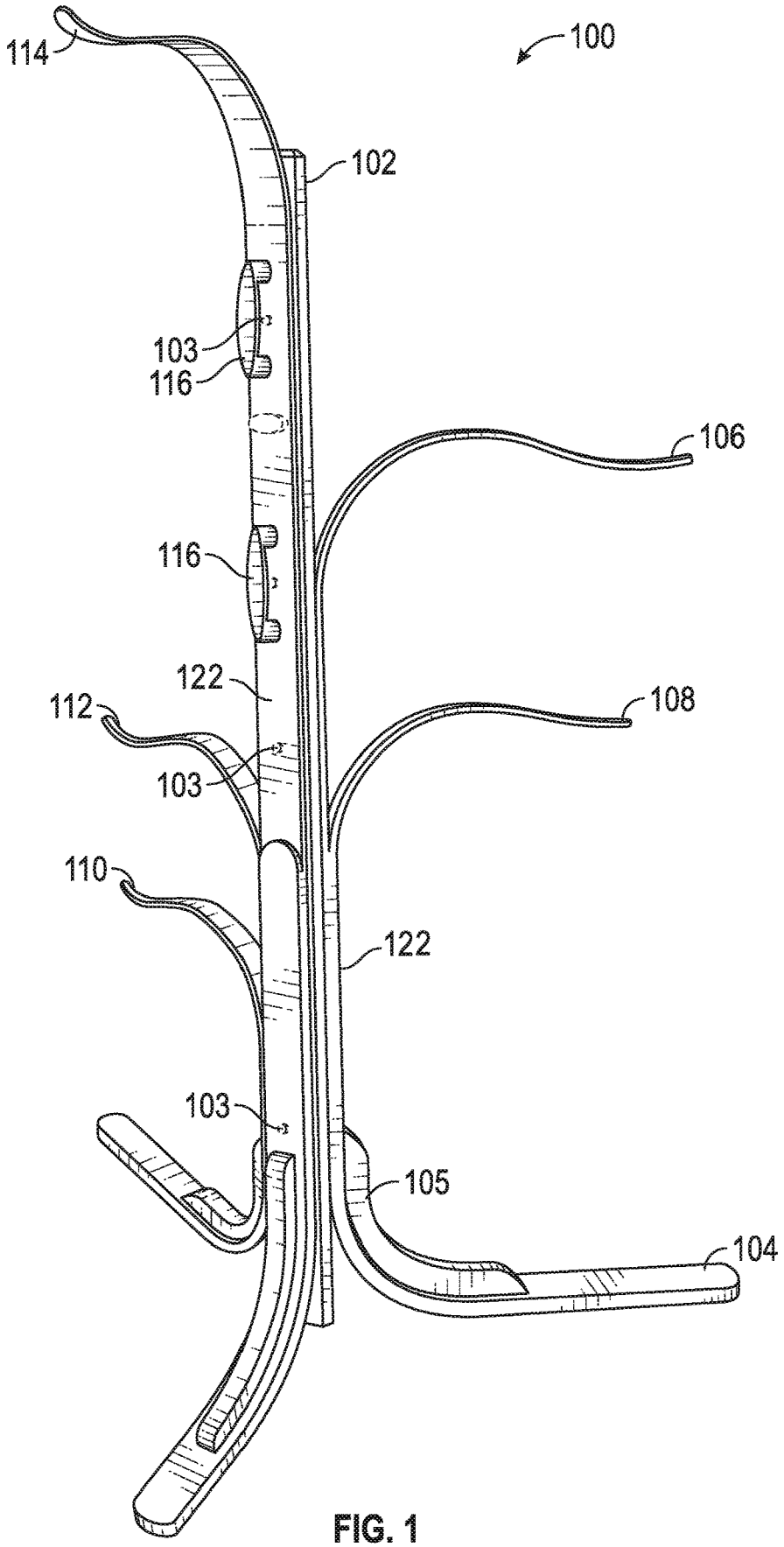
FIG. 1 is a perspective view of the apparatus, showing five branches and three supporting roots around a central post and showing two handles on the central post.
Figure 2:
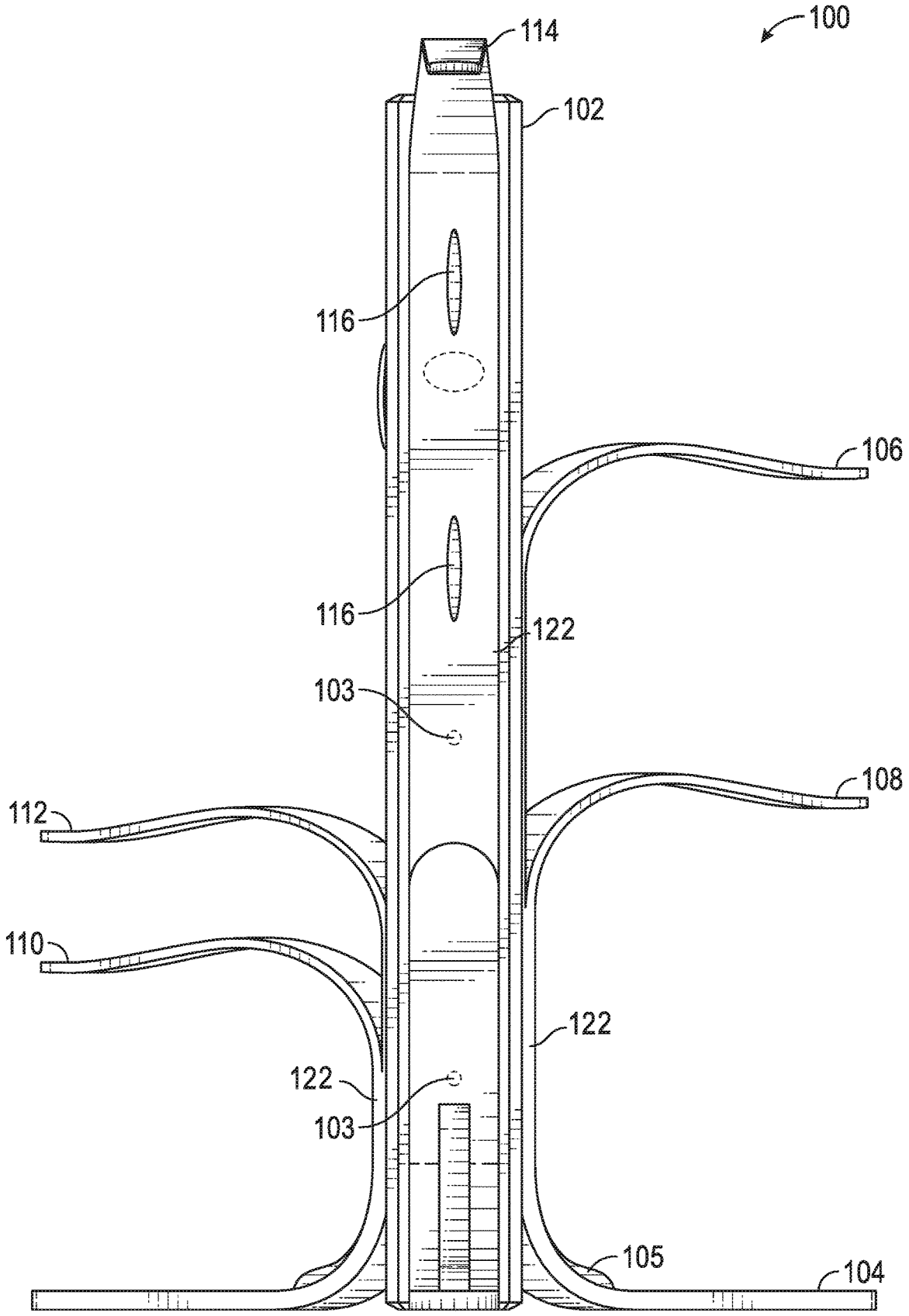
FIG. 2 is a front elevation view of the apparatus, showing five branches and two handles on the central post.
Figure 3:
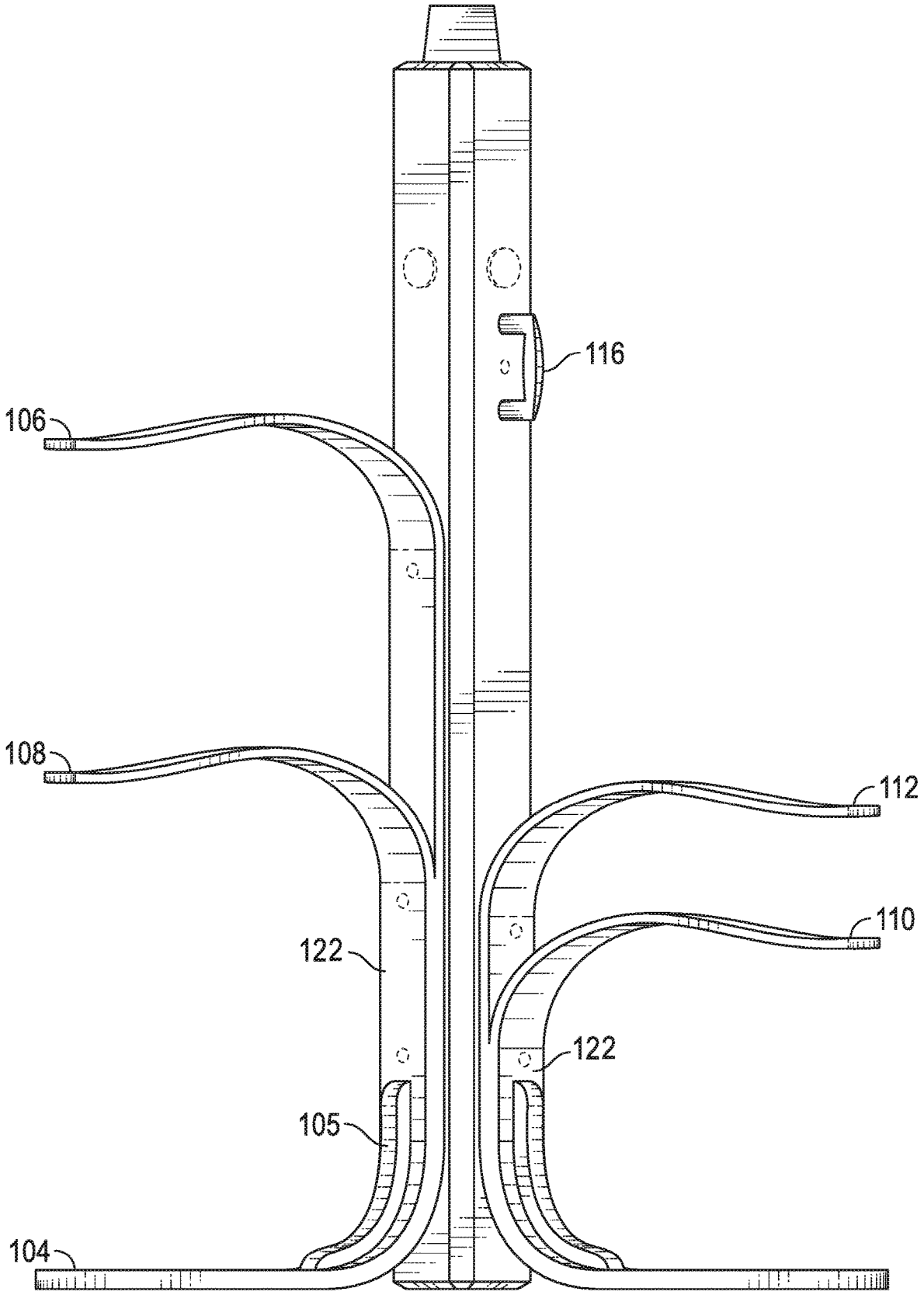
FIG. 3 is a left side elevation view of the apparatus, showing one handle and four branches from the central post.
Figure 4:
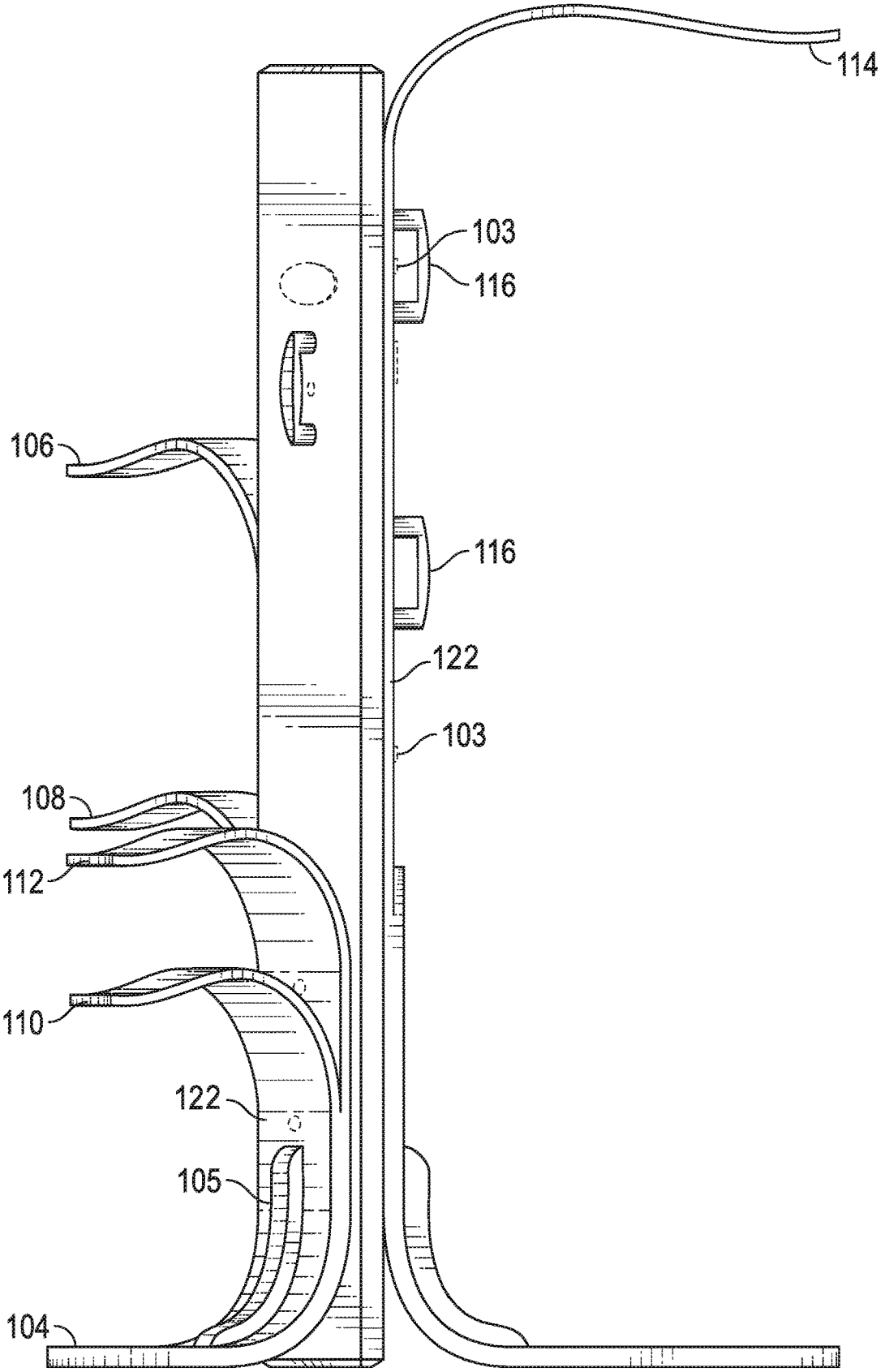
FIG. 4 is a rear elevation view of the apparatus, showing five branches and three handles on the central post.
Figure 5:
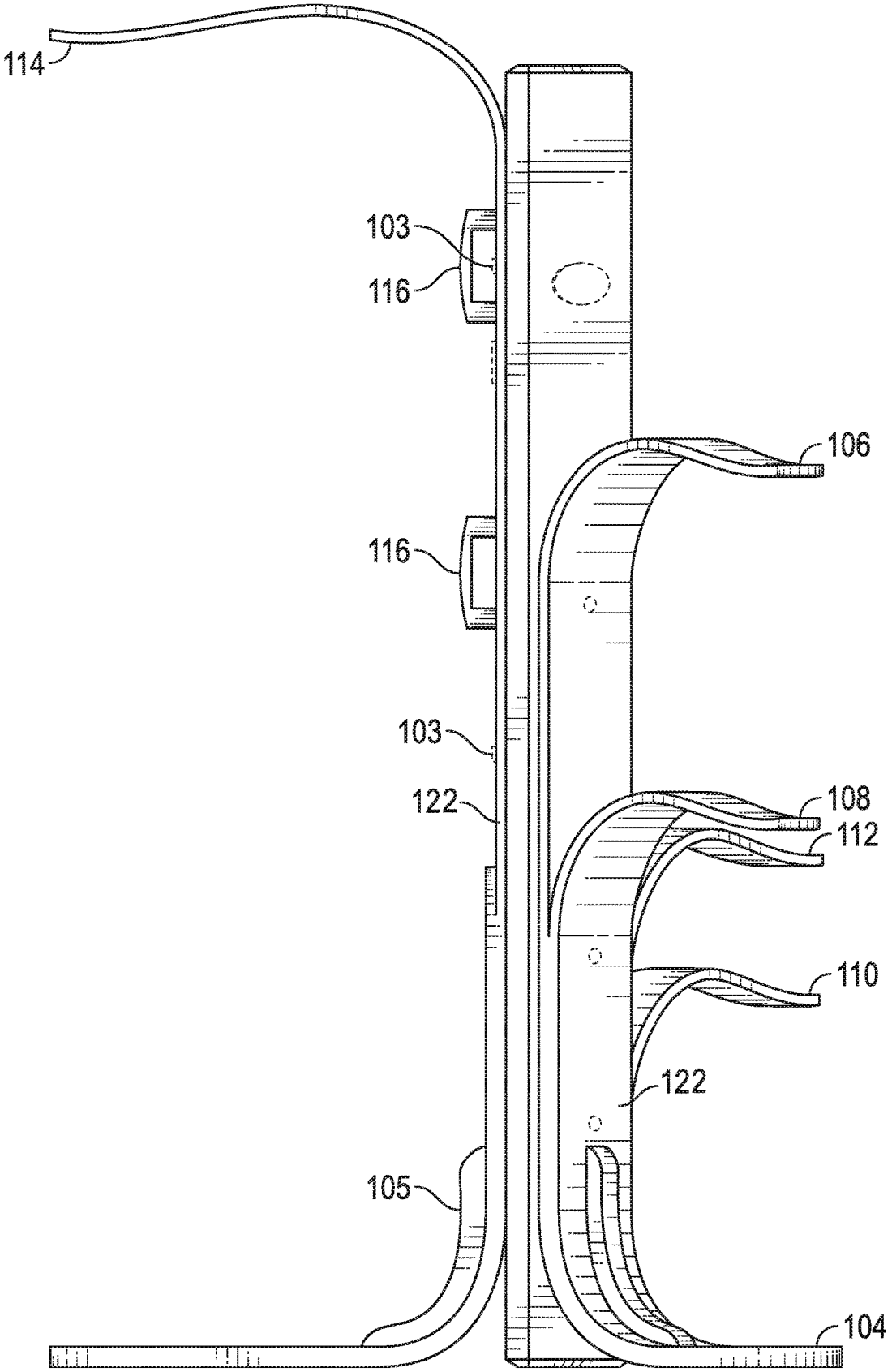
FIG. 5 is a right side elevation view of the apparatus, showing five branches and two handles on the central post.

Referring to FIGS. 1-5 and 35, a willow workout device (apparatus) 100 includes a tubular central post 102, which is triangular in cross-section. Each wall 101 of the central post 102 supports a root 104 as well as one or more branches that are secured to the post 102. The roots 104 and the various branches are secured to the central post by fasteners 103. The roots 104 also are braced by buttresses 105. Preferably, the roots 104 are of one piece with corresponding branches. For example, the branches of the workout apparatus include an upper body branch 106, mid-body branches 108 and 110, a lower branch 112, and a hanging branch 114. Proceeding counterclockwise around the central post 102, the branches 106, 108 are disposed above each other at a first wall of the central post and are integral with a first root 104 as a first limb 109; the branches 110, 112 are disposed above each other and below a single handle 116 at a second wall of the central post and are integral with a second root 104 as a second limb 113; and the branch 114 is disposed above two handles 116, at the upper end of a third wall of the central post, and is integral with a third root 104 as a third limb 115.

According to certain embodiments the roots and branches are formed of a laminate material, e.g. ashwood or bentwood laminates; alternatively the roots and branches can be formed of a fibrous composite material, e.g., glass or carbon fibers in a polymer matrix. The central post can be formed of boards, or as an integrally cast or extruded (e.g., glass or carbon fiber composite) tube. With reference to any components formed of a fibrous composite material, the fibers may be randomly or homogeneously oriented.

Thus, embodiments of the invention provide the apparatus 100 for physical exercise. The apparatus comprises a central post 102 (which may be triangular tubular in cross-section, formed by the three walls 101); at least three roots 104 protruding generally horizontally in differing directions from the base of the post; and at least three branches 106, 108, 110, 112, 114 that protrude generally horizontally from the post at differing heights and in differing directions, wherein the at least three branches are composed of fibrous material with the fibers oriented generally along the lengths of the branches. The apparatus 100 also may include at least one handle 116 that is fastened to the central post at a height among the at least three branches. Indeed, the apparatus 100 may comprise at least one additional (fourth, fifth, or further) branch that protrudes generally horizontally from the post in a same direction but at a different height as one of the at least three branches. Generally, each of the at least three branches protrudes in a same direction as a respective one of the at least three roots. In certain embodiments, each of the at least three branches is formed as a contiguous part of a limb 109, 113, or 115 that also includes a respective one of the at least three roots. Generally, each of the at least three limbs is removably fastened to the post at a stem portion 122 of the limb that connects the respective branch and root. Typically, the at least three roots protrude from the post with substantially uniform angular spacing.

For example, an embodiment of the invention provides the apparatus 100 as a six foot, forty five pound, upright structure, fabricated of bent ash wood laminations. The five interactive exercise 'limbs' 106, 108, 110, 112, 114 and three support handholds 116 are mounted onto the central triangular post 102, which is balanced and fortified by the tripodal roots 104. This specialized array of exercise limbs, designed and tested by an Orthopedic Specialist/Physical Therapist, provides for upper and lower extremity and full body workouts, through a unique exercise routine. Its design and qualities contribute to its multi-functionality; the three most important attributes are responsive resistance, controlled balance and stabilized stretch. The height and location of the multilevel exercise limbs and handholds are conducive to a variety of exercise positions and objectives to provide for an all-body workout, as one moves through 'unlimited' positions. Responsive resistance of the pliable limbs, arising from their unique design and composition, matches one's forced output as they train muscle. Contour, length and composition of the limbs create the appropriate force response and differential grade; thus, instantaneous adjustments, required by one's changing performance, can occur with proximal or distal slides of hand or foot to achieve more or less resistance, respectively. In addition, through its provision of controlled balance, this structure enables one to assume more aggressive, prolonged body positions to accomplish 'body weight resistance' strengthening.

Thus, users may satisfy the prerequisites of stability through balance, with the aid of the Willow Workout System, to advance into the challenging positions for isolation and repetitive resistance training of the targeted tissue. Willow Workout provides the necessary balance assistance for 'user-controlled', full range of motion, progressive positions, while using only body weight for resistance. Employing this efficient and user-friendly approach to balanced resistance exercise, the novel multi-limbed strategy of the Willow Workout can be applied to the entire body. Willow Workout also provides exceptional stabilized soft tissue stretch leading to improved flexibility and musculoskeletal health. The direct correlation of flexibility and good physical health supports the need for 'reach and pull' stretch routines. A short ten minute overall body stretch has long been known to be soothing and beneficial for wellness of joints, body and mind. However, without the assistance of a stabilizing structure, individuals cannot achieve effective positions of deep stretch on their own. Active assistance of the Willow Workout System, allows stretch progression through interaction with its 'limbs' and balance points. Using a longitudinal direction of pull, one follows an autonomous routine to elongate and comfortably stretch the entire body, as desired. As the force is longitudinal and counteracted by the floor, this device maintains stability for reach and stretch routines.

With its potential for isolated, musculoskeletal recovery, rehabilitation of any disorder involving joint contracture, reduced range of motion, weakness, pain or injury can be achieved through progressive positions of stretch and strengthen. For example, disorders such as Frozen Shoulder, Knee Trauma (post joint replacement or injury) or poor Vertebral Alignment can be rehabilitated through soft tissue advancements in strength and flexibility, by way of this diverse and effective device. Its simplistic function contrasts with the classic strength training tools currently available on the market today. Unlike the massive, weight training machines comprised of heavy, metal systems of bar bells, weights, pulleys, power racks or the inconvenient and time consuming trips to the gym, the Willow Workout system provides a convenient, highly effective, yet simple method of home exercise. By repetitive, oppositional, resistance-based strength training of the torso, upper and lower extremities, this concept provides a functionally necessary aid to exercise routines, achieved by a force exerted equals force matched Especially paramount to the success of this device is its provision of instantaneous adjustments to the amount of resistance or to the desired position of stretch, as one alters their performance. Using the simple concepts of balance and isolated soft tissue control, the Willow Workout provides a novel method of stretching and strengthening musculoskeletal tissues through controlled, balanced, resistance training. Natural looking, esthetically pleasing, user-friendly, easy to assemble, cost effective and functional, this device has vast potential within both the Athletic and the Rehabilitation populations.

Figure 6:
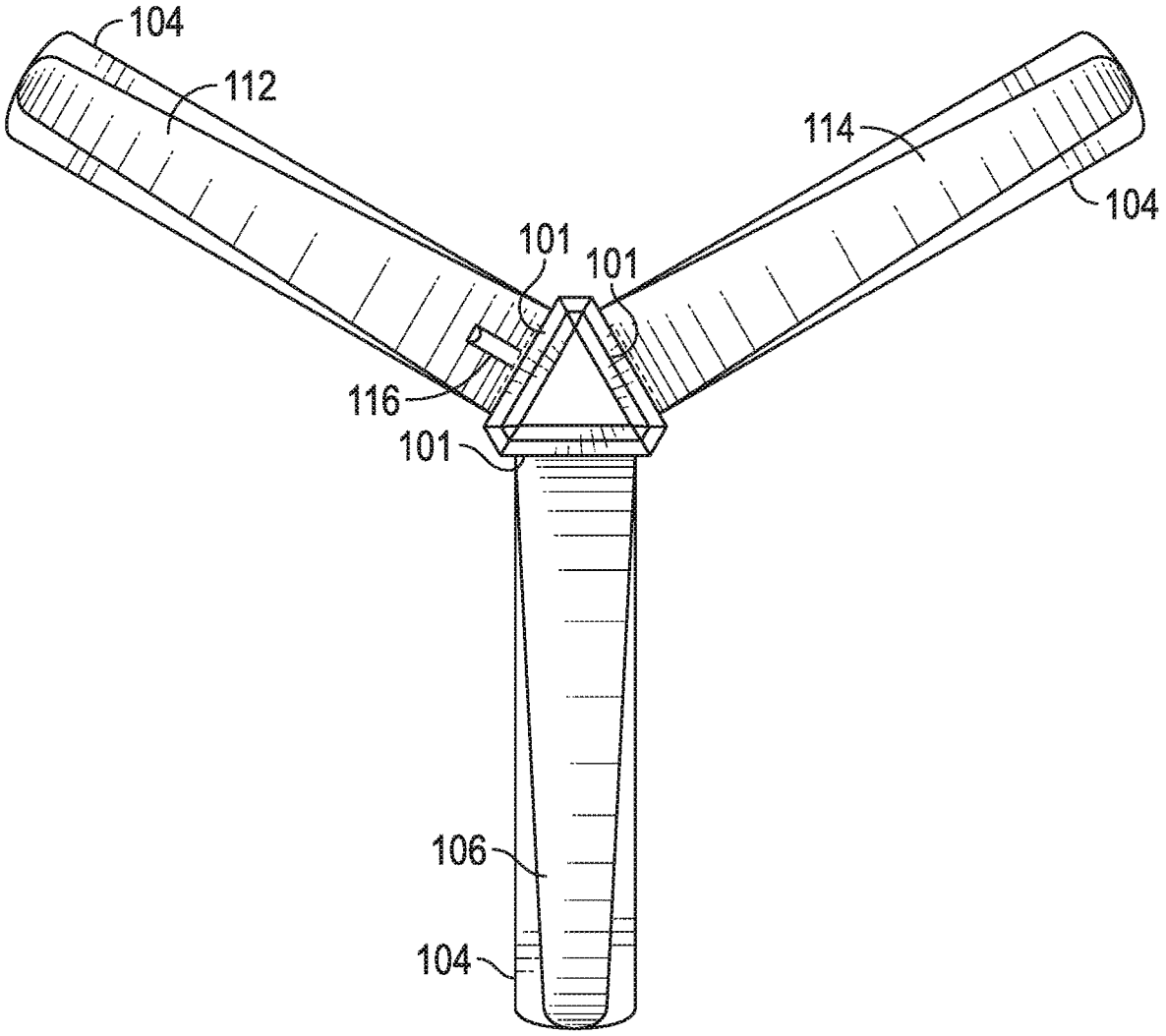
FIG. 6 is a top plan view of the apparatus, showing three branches, a handle, and three support roots from the tubular central post.
Figure 7:
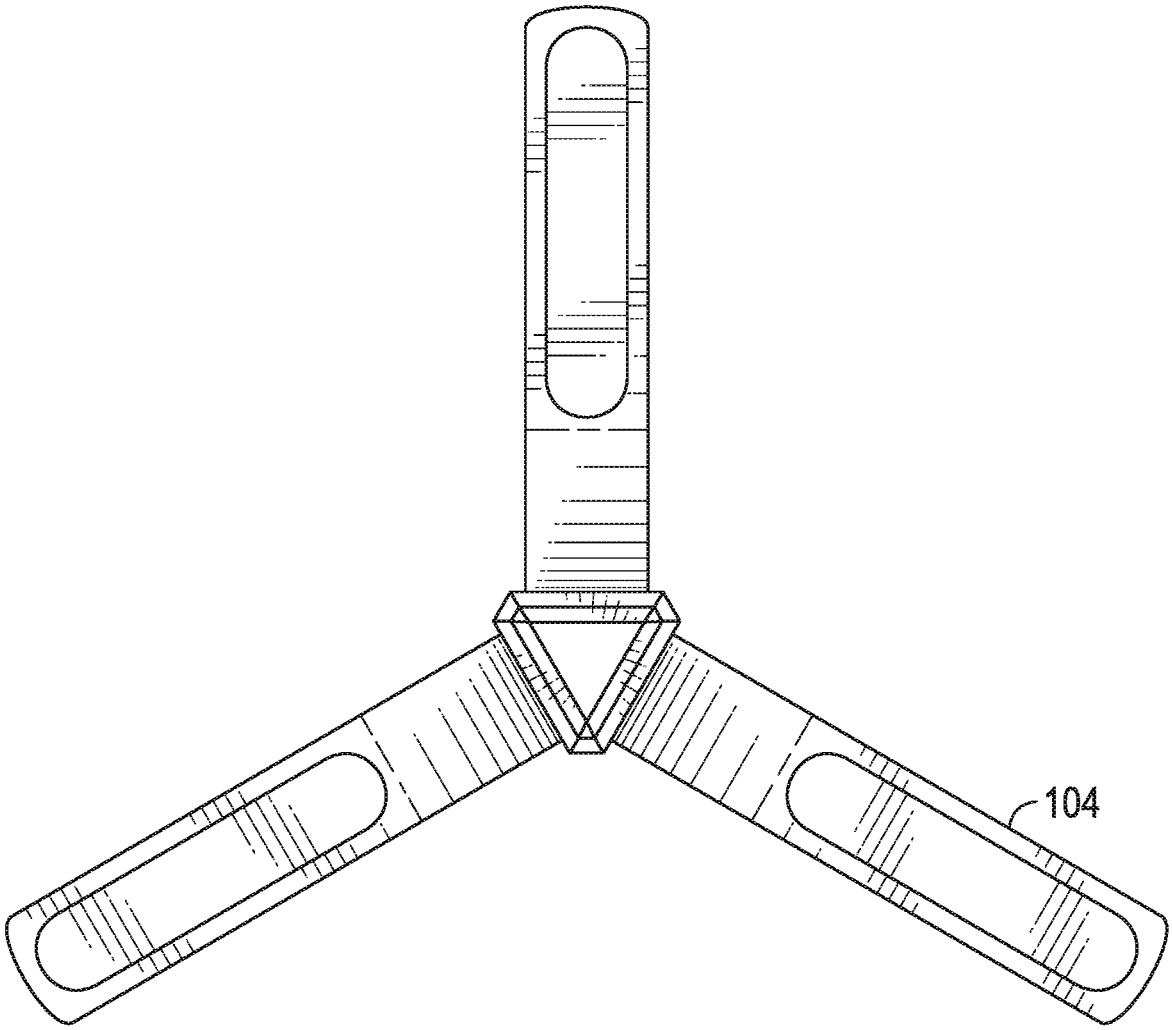
FIG. 7 is a bottom plan view of the apparatus, showing three support roots from the tubular central post.
Figure 8:
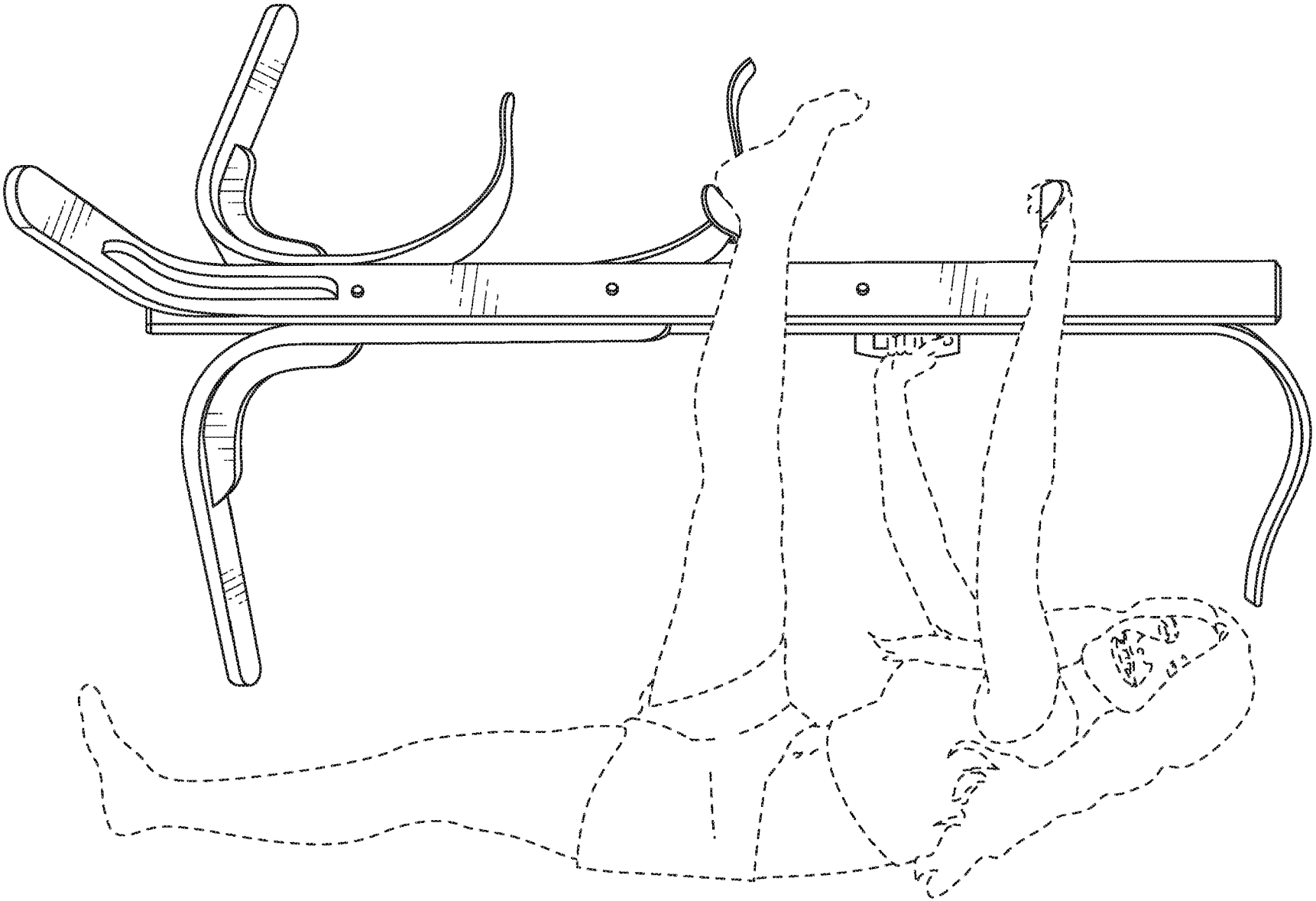
FIGS. 8-34 illustrate modes of use of the apparatus.
Figure 9:
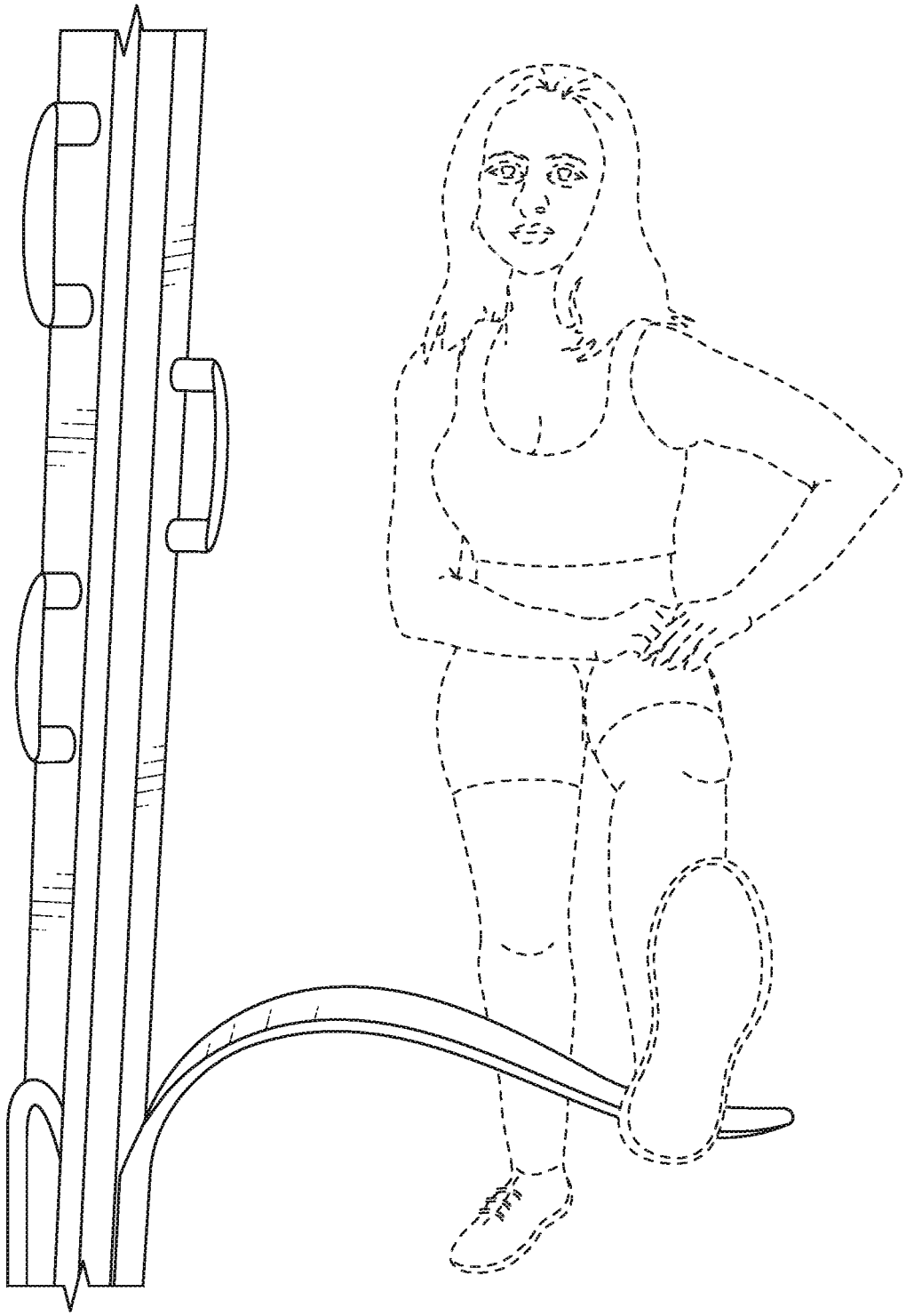
Figure 10:
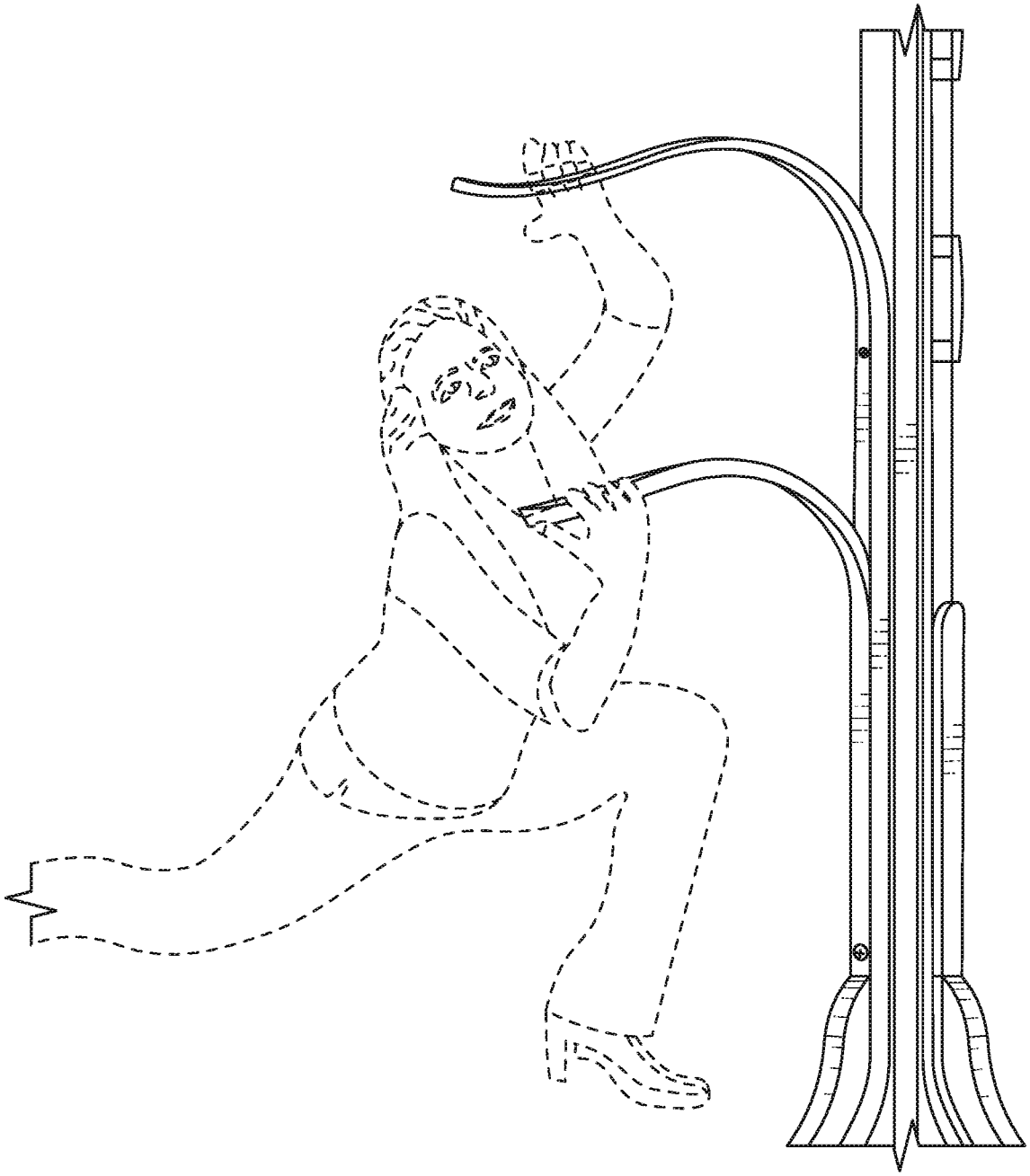
Figure 11:
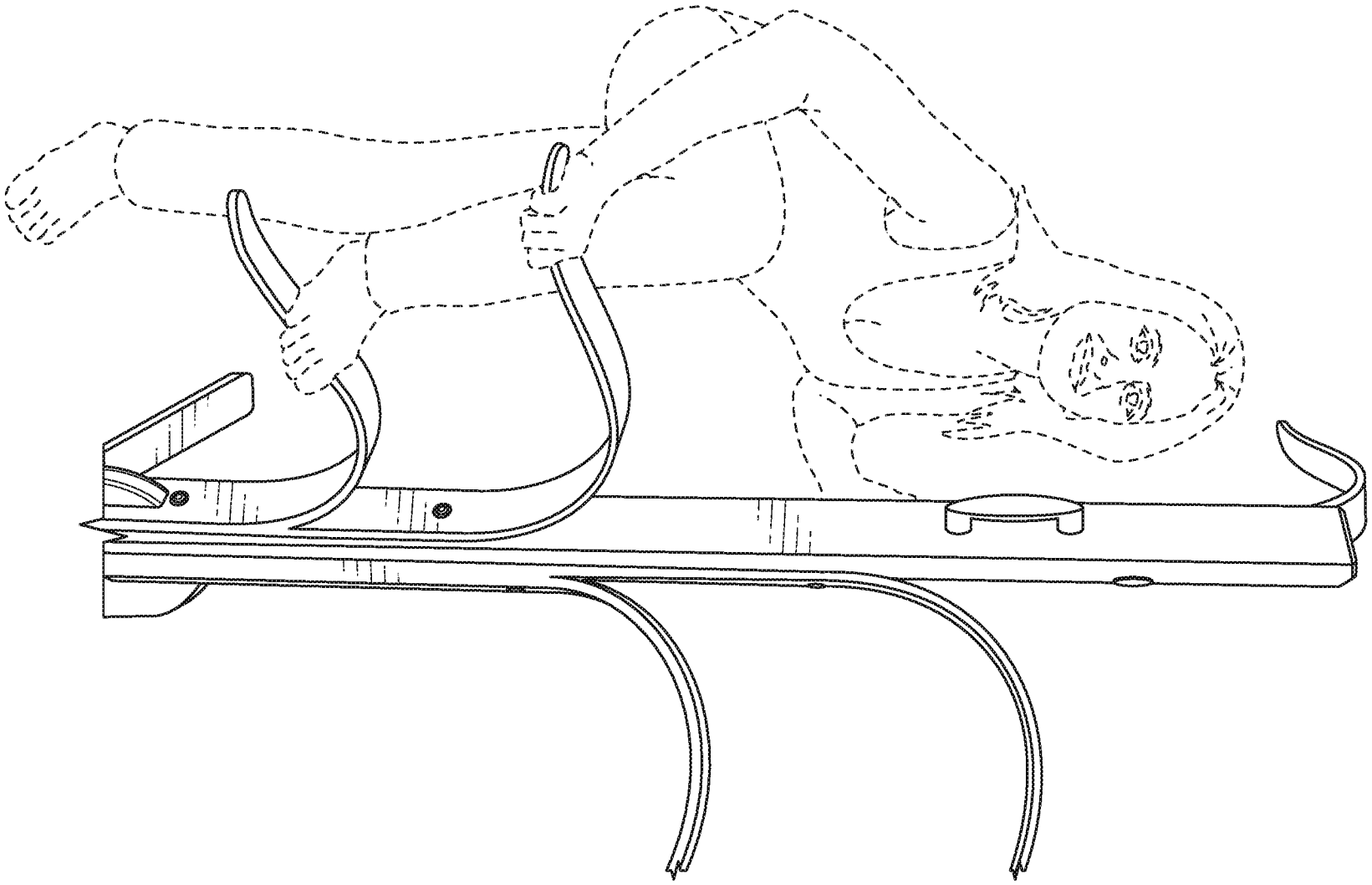
Figure 12:
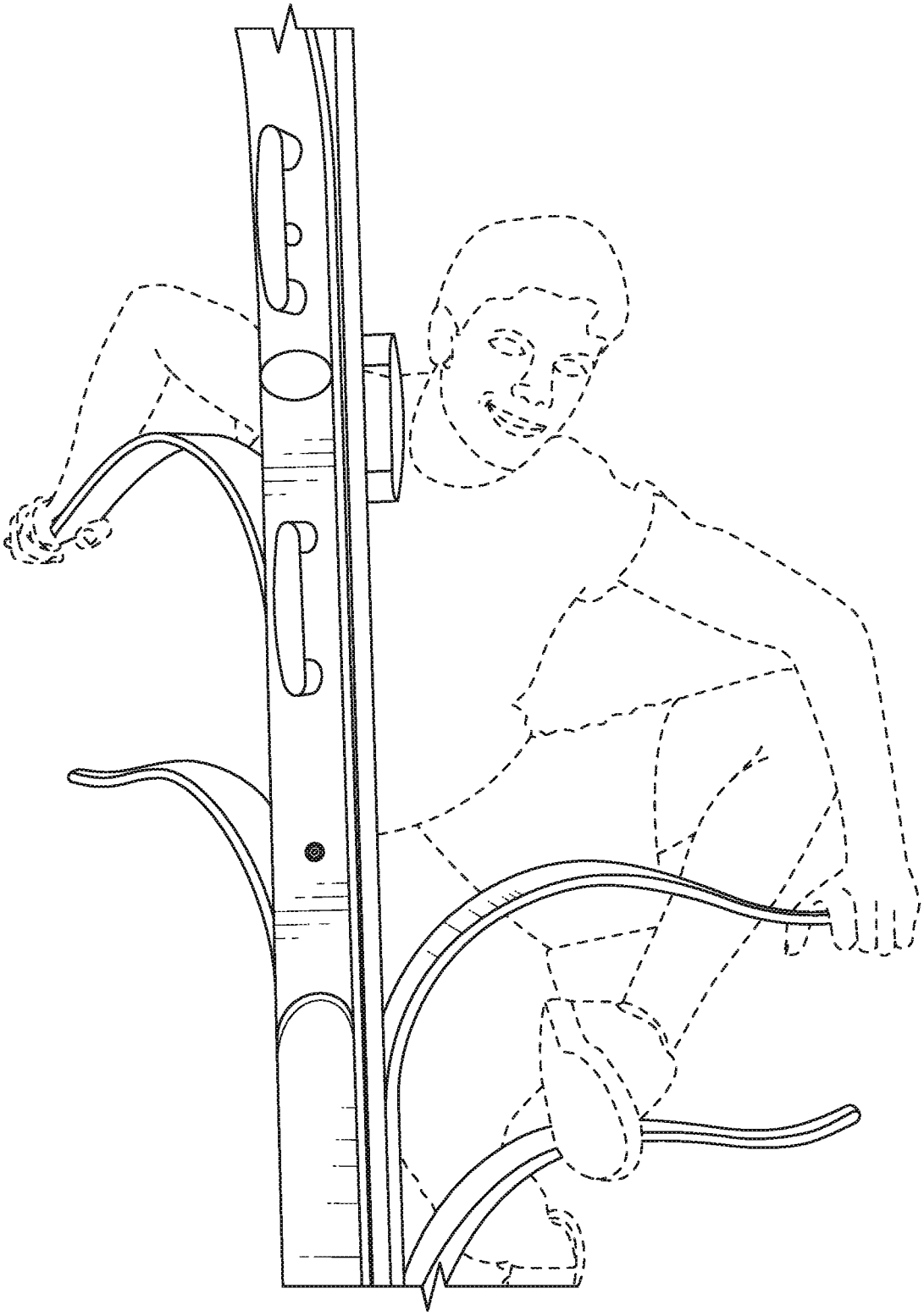
Figure 13:
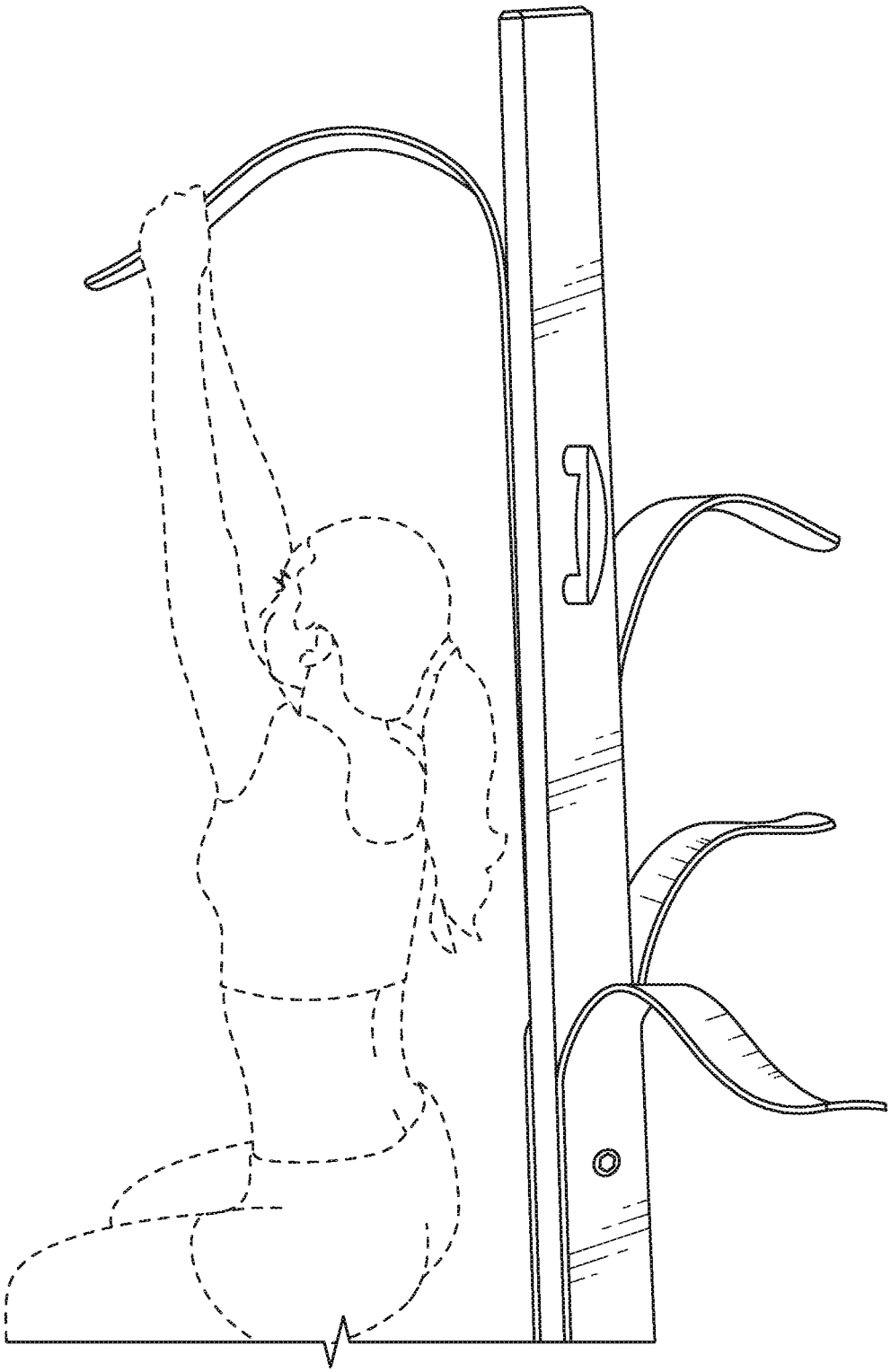
Figure 14:
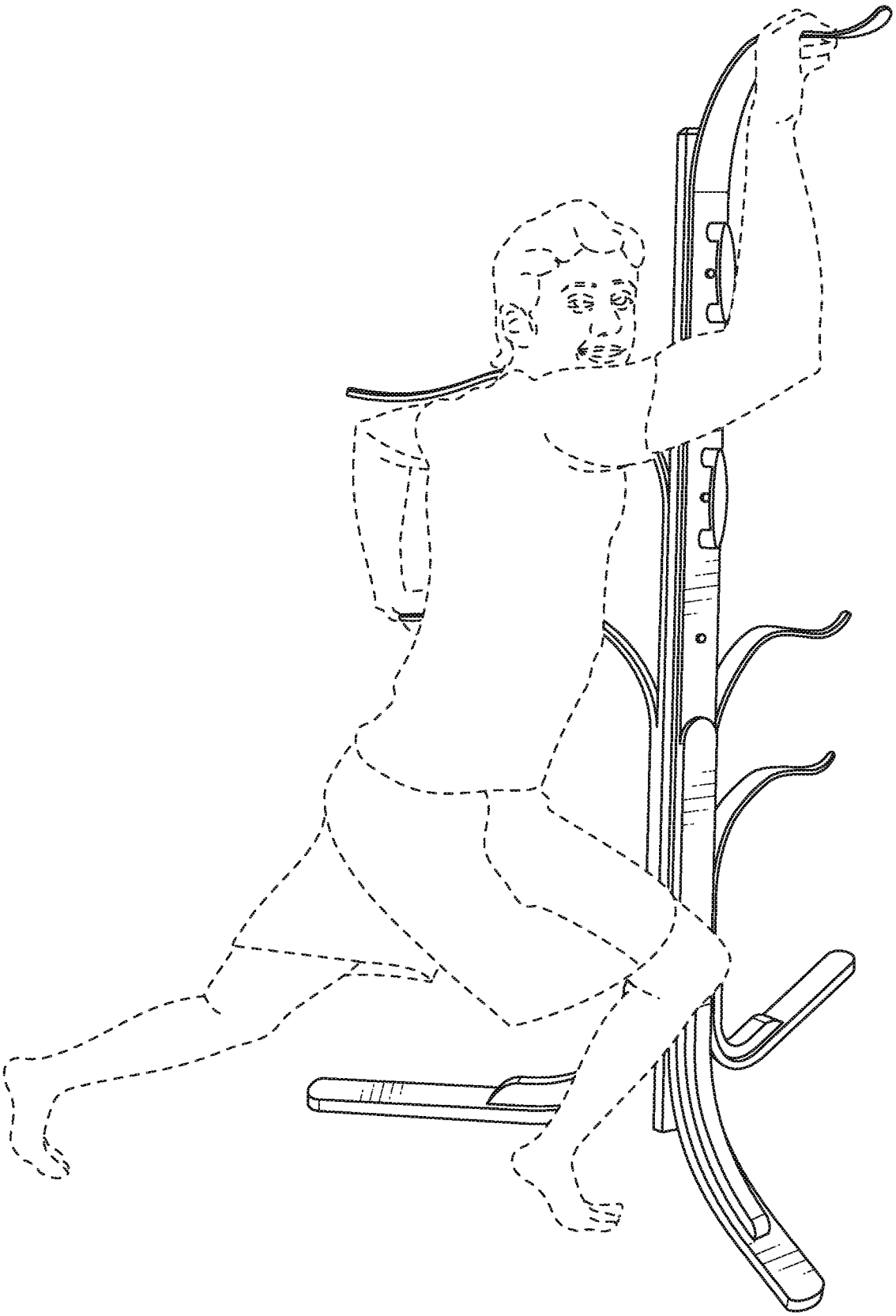
Figure 15:
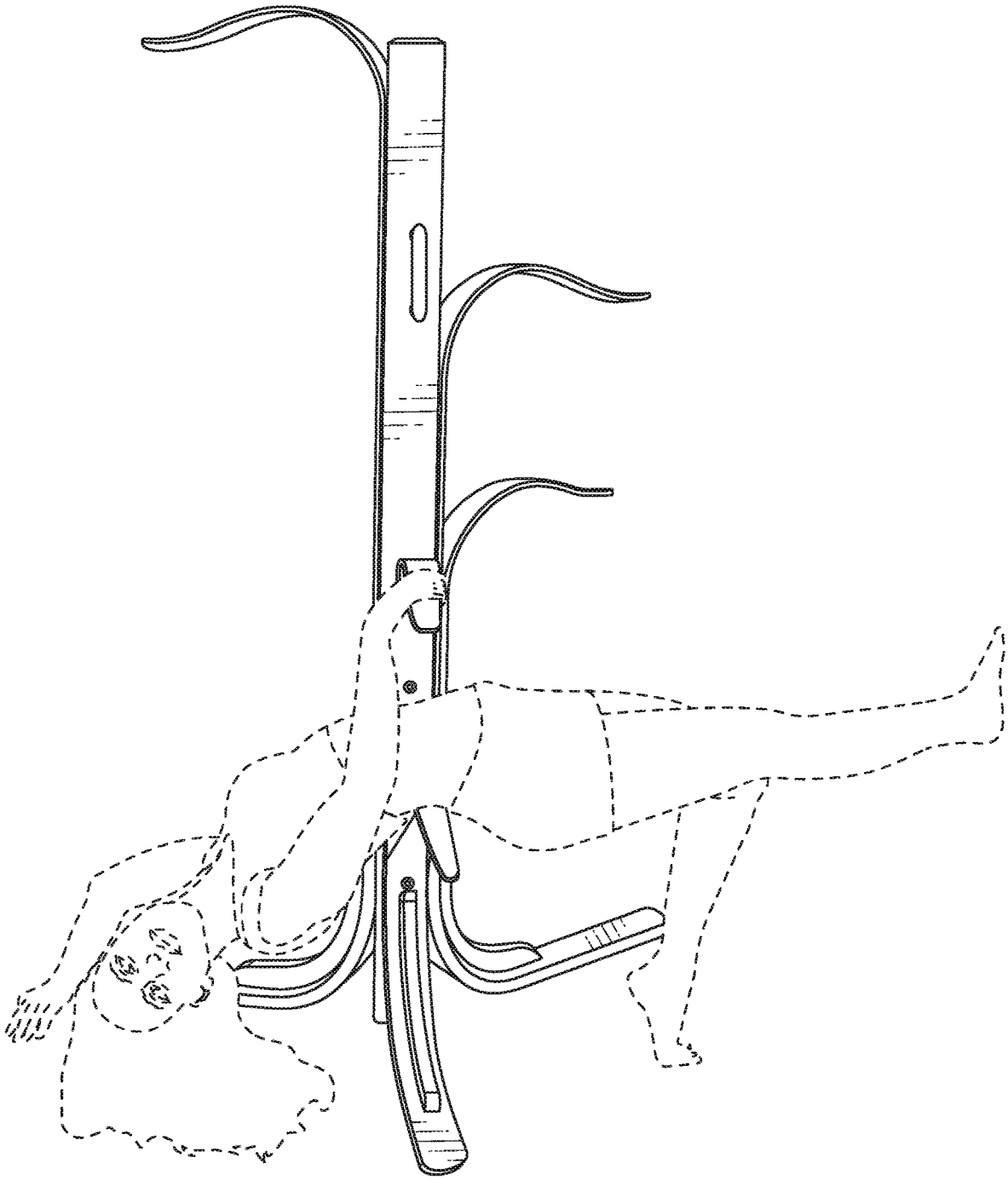
Figure 16:
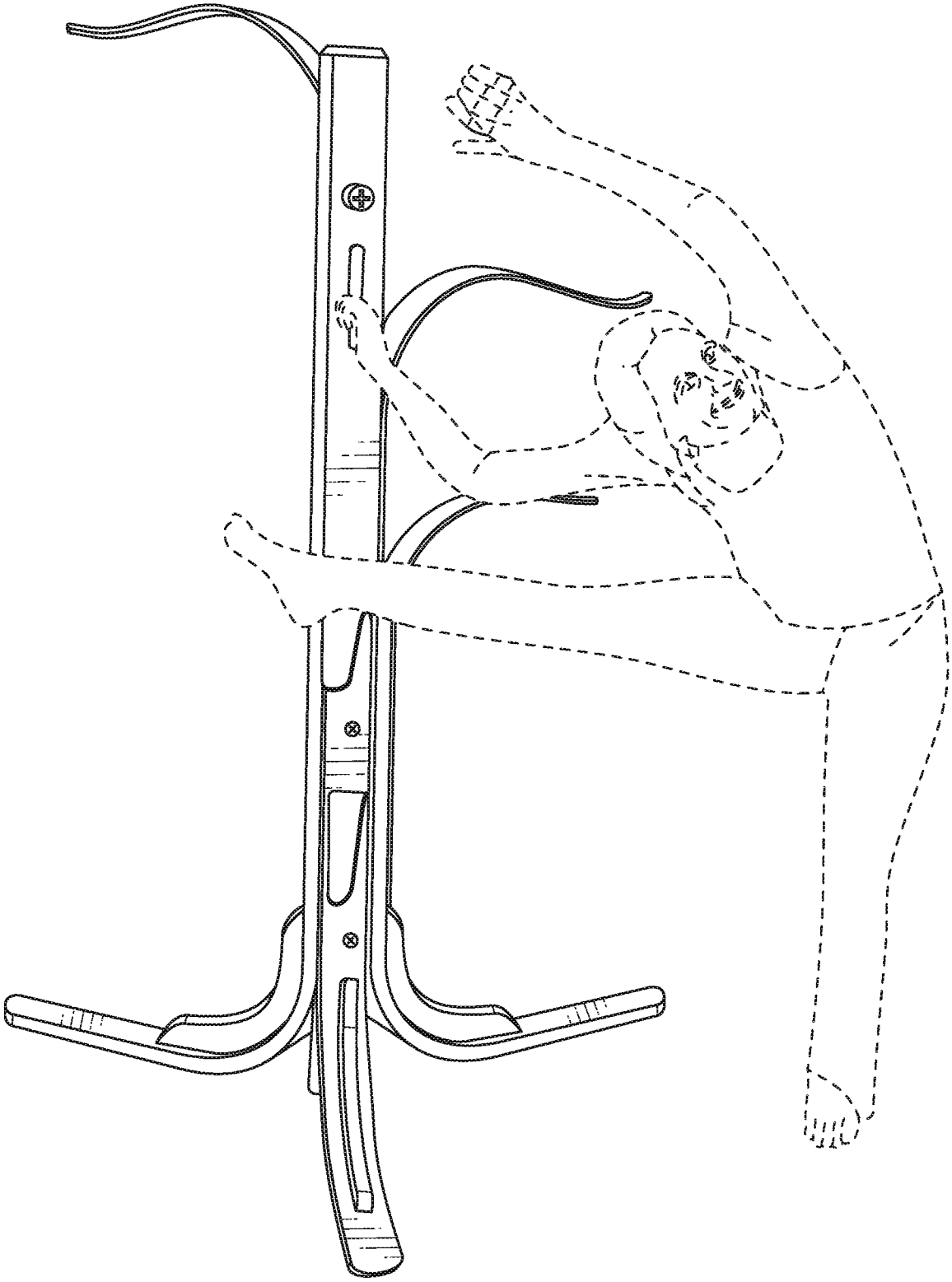
Figure 17:
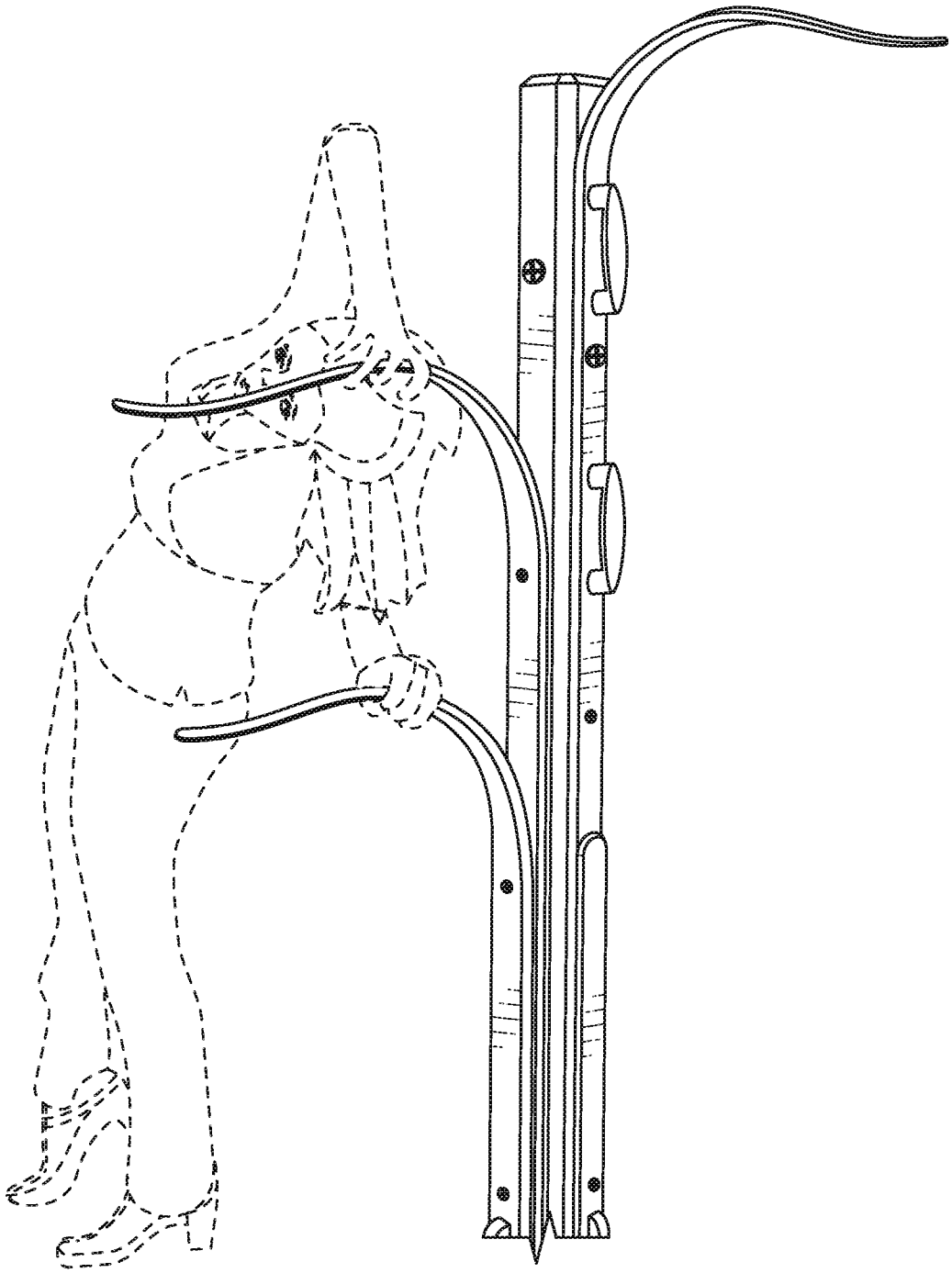
Figure 18:
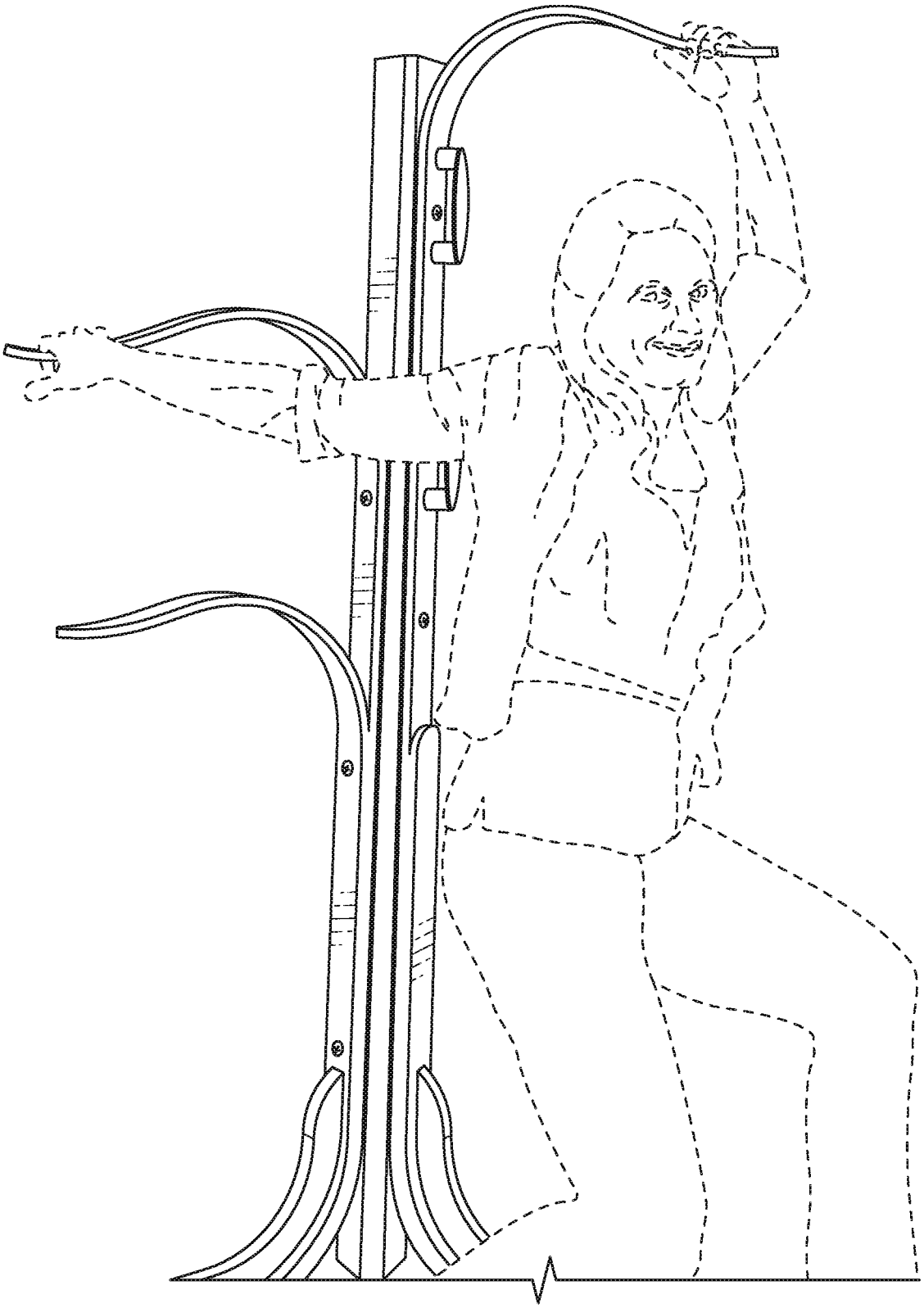
Figure 19:
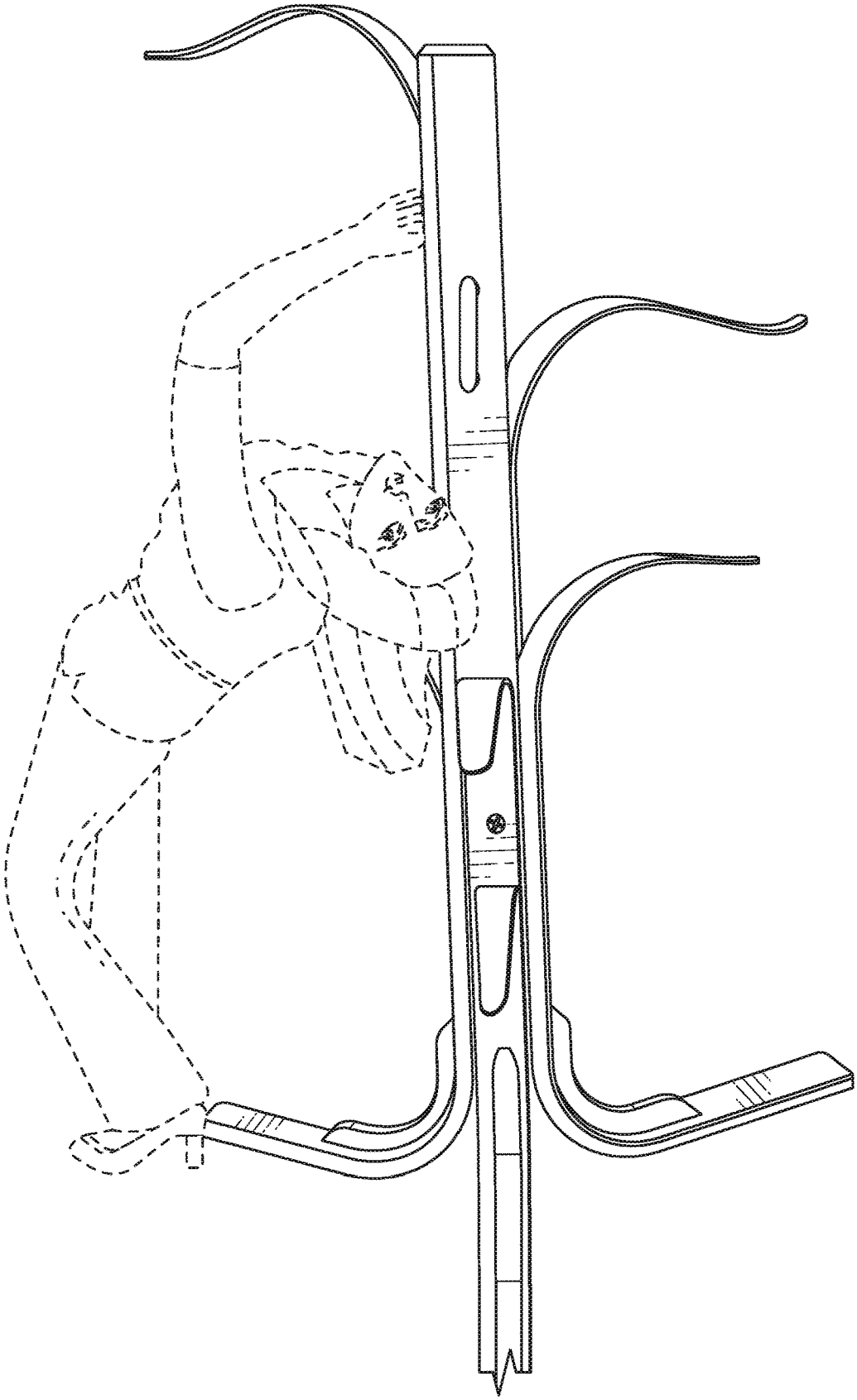
Figure 20:
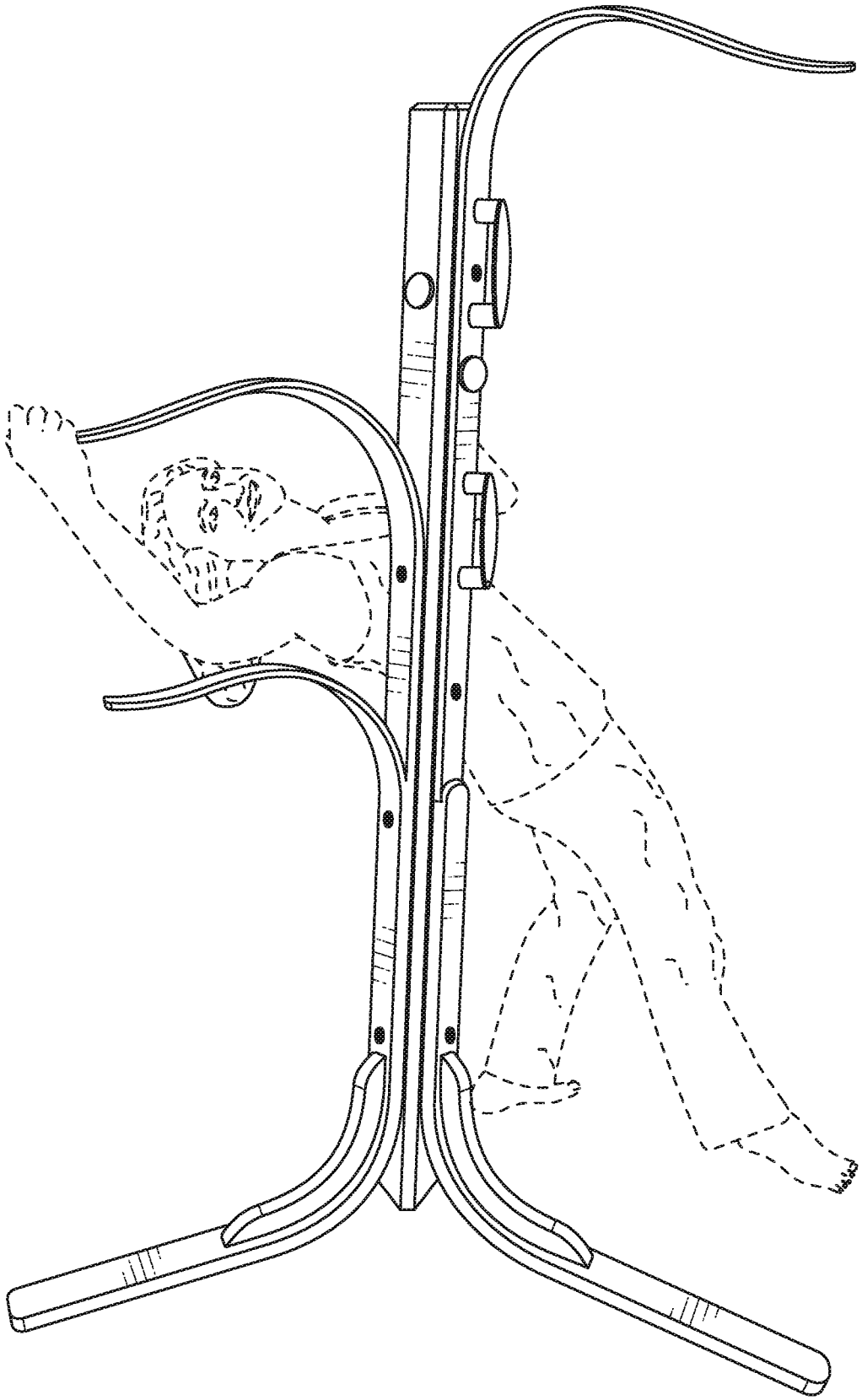
Figure 21:
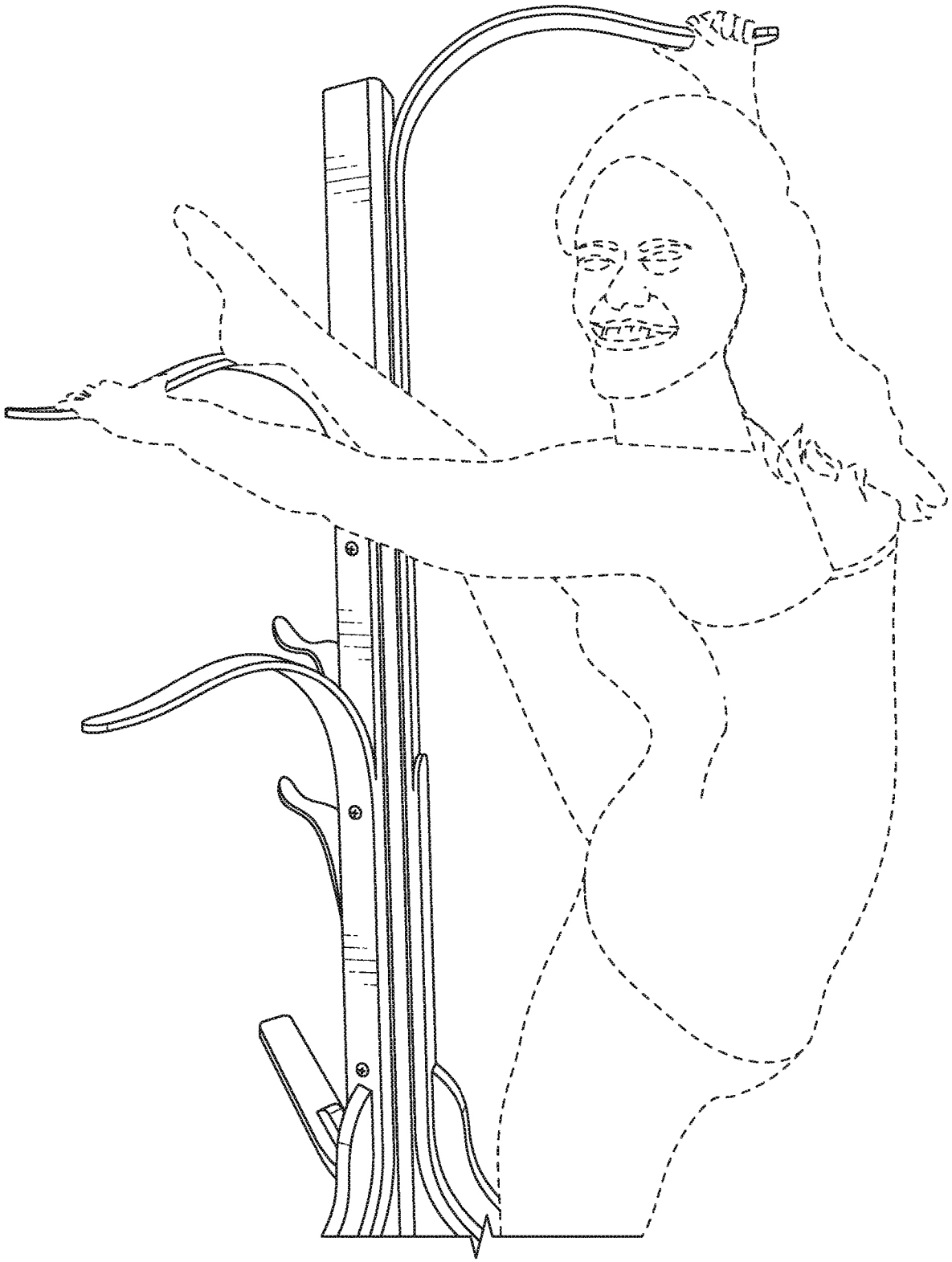
Figure 22:
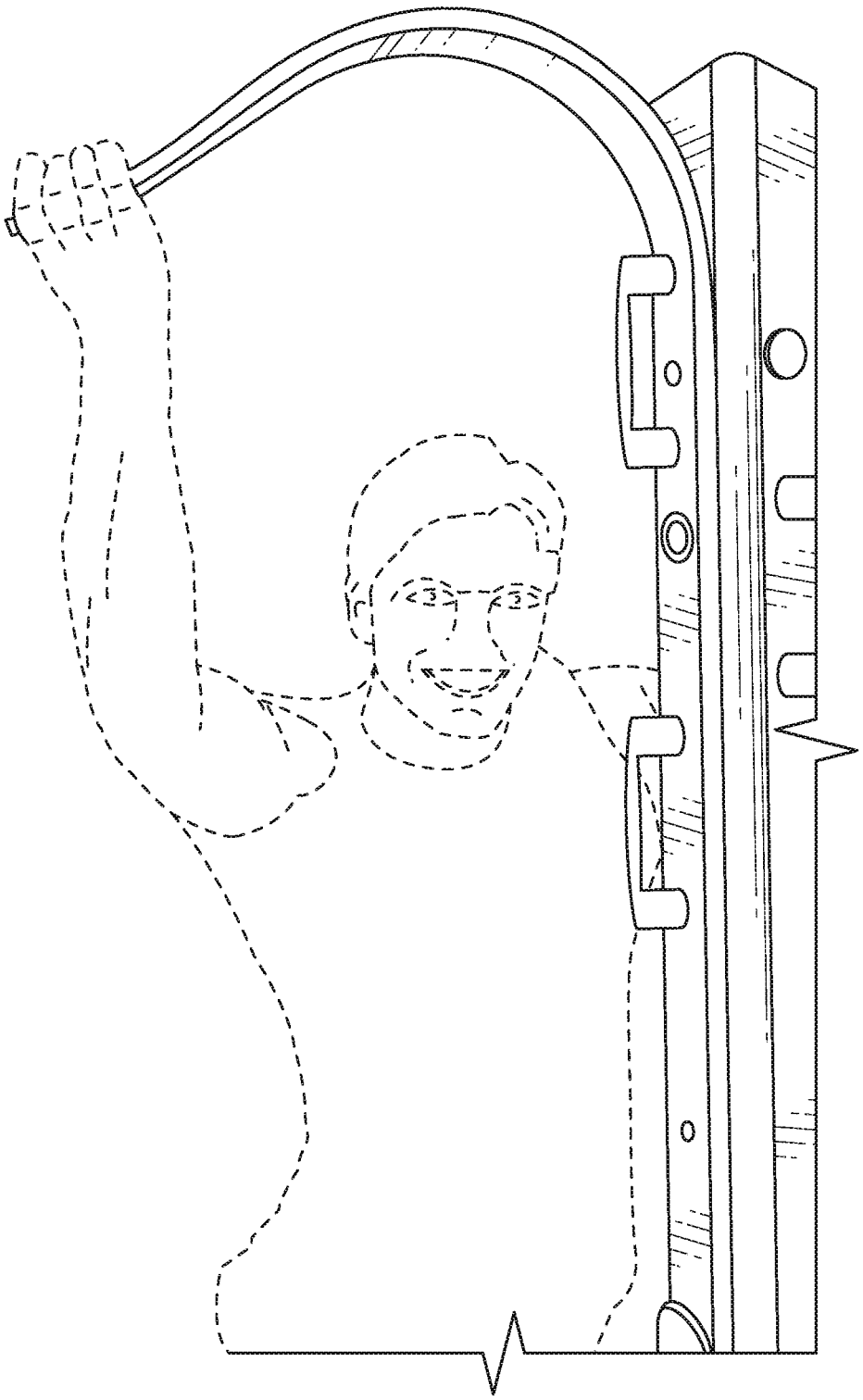
Figure 23:
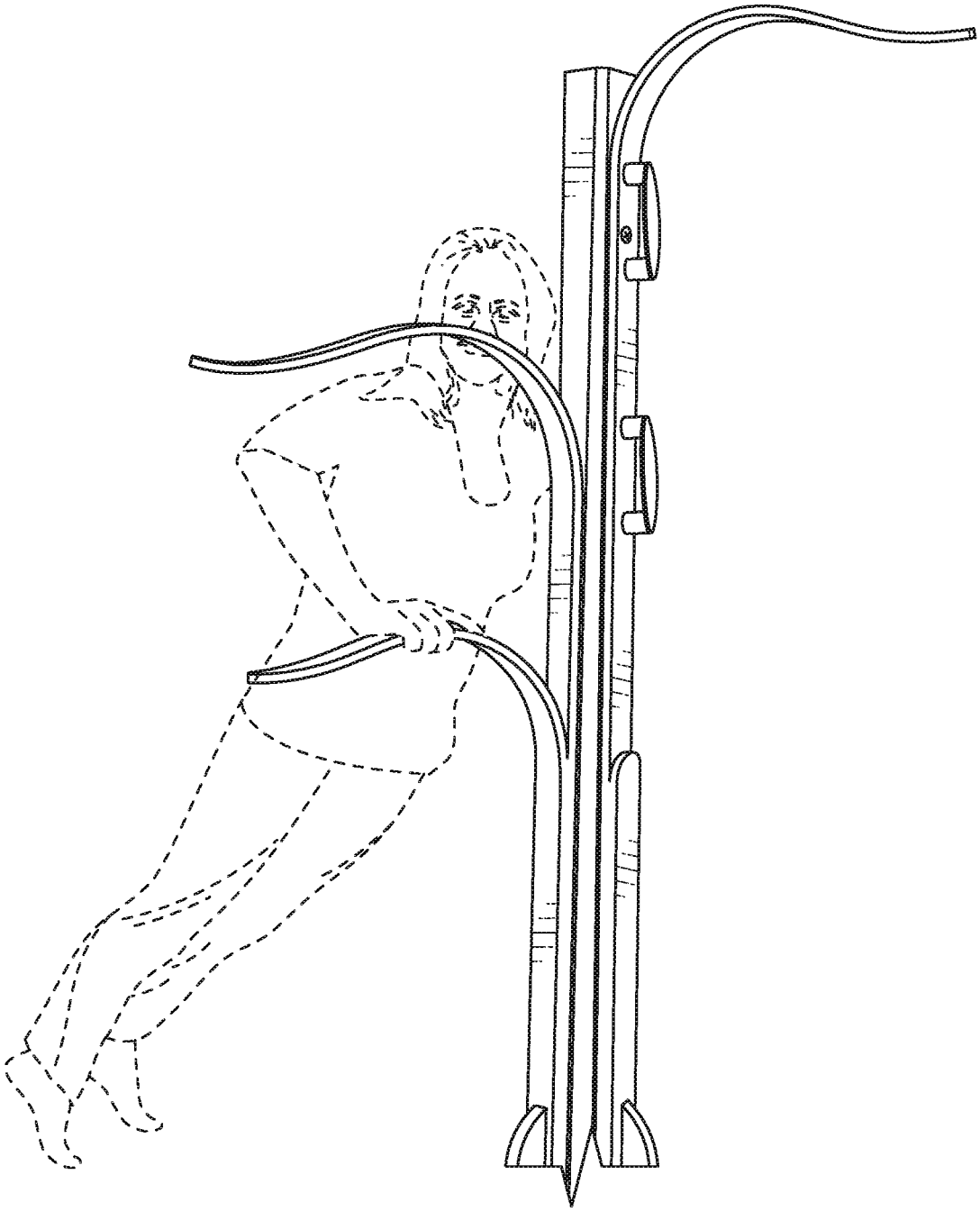
Figure 24:
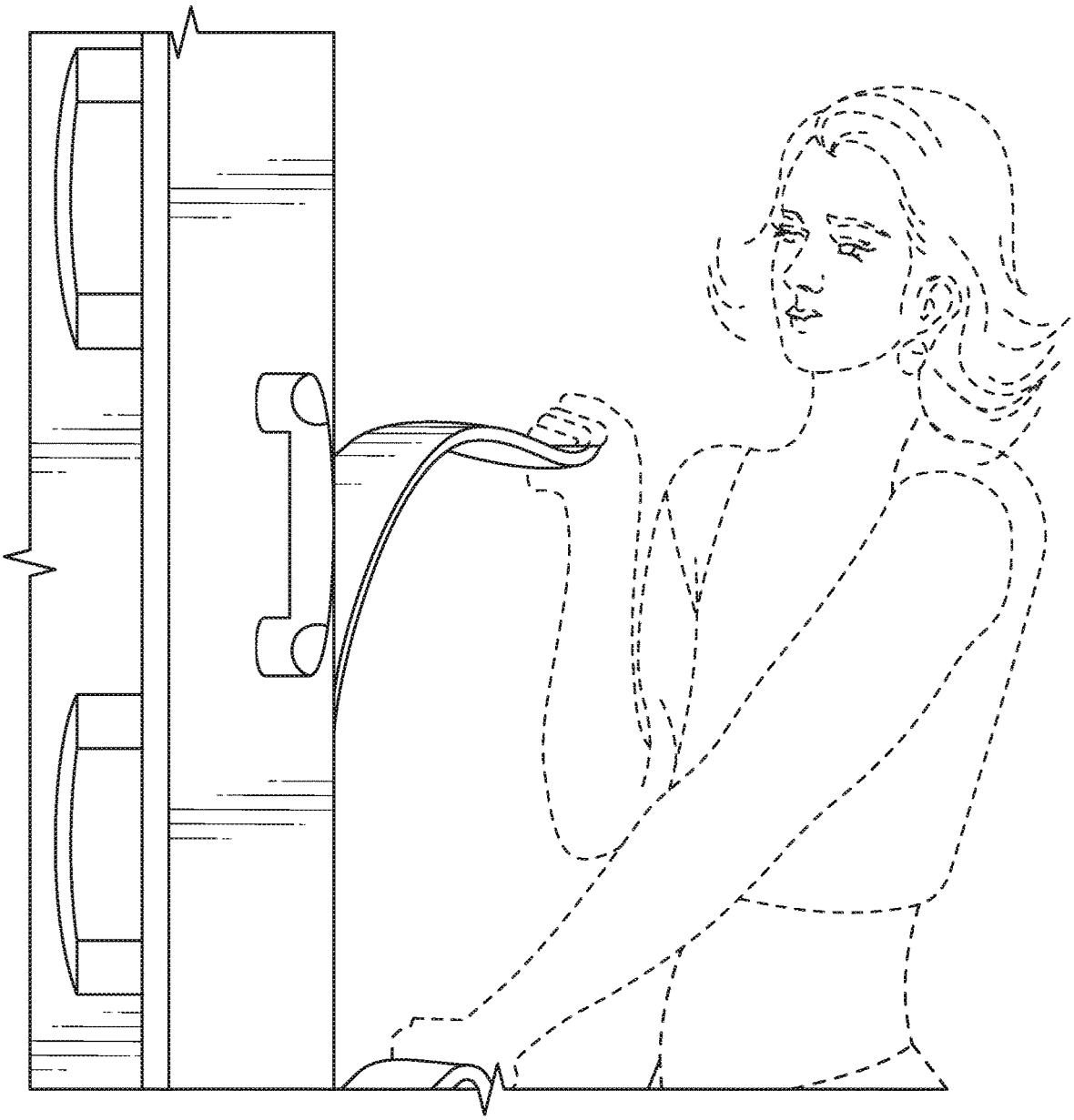
Figure 25:
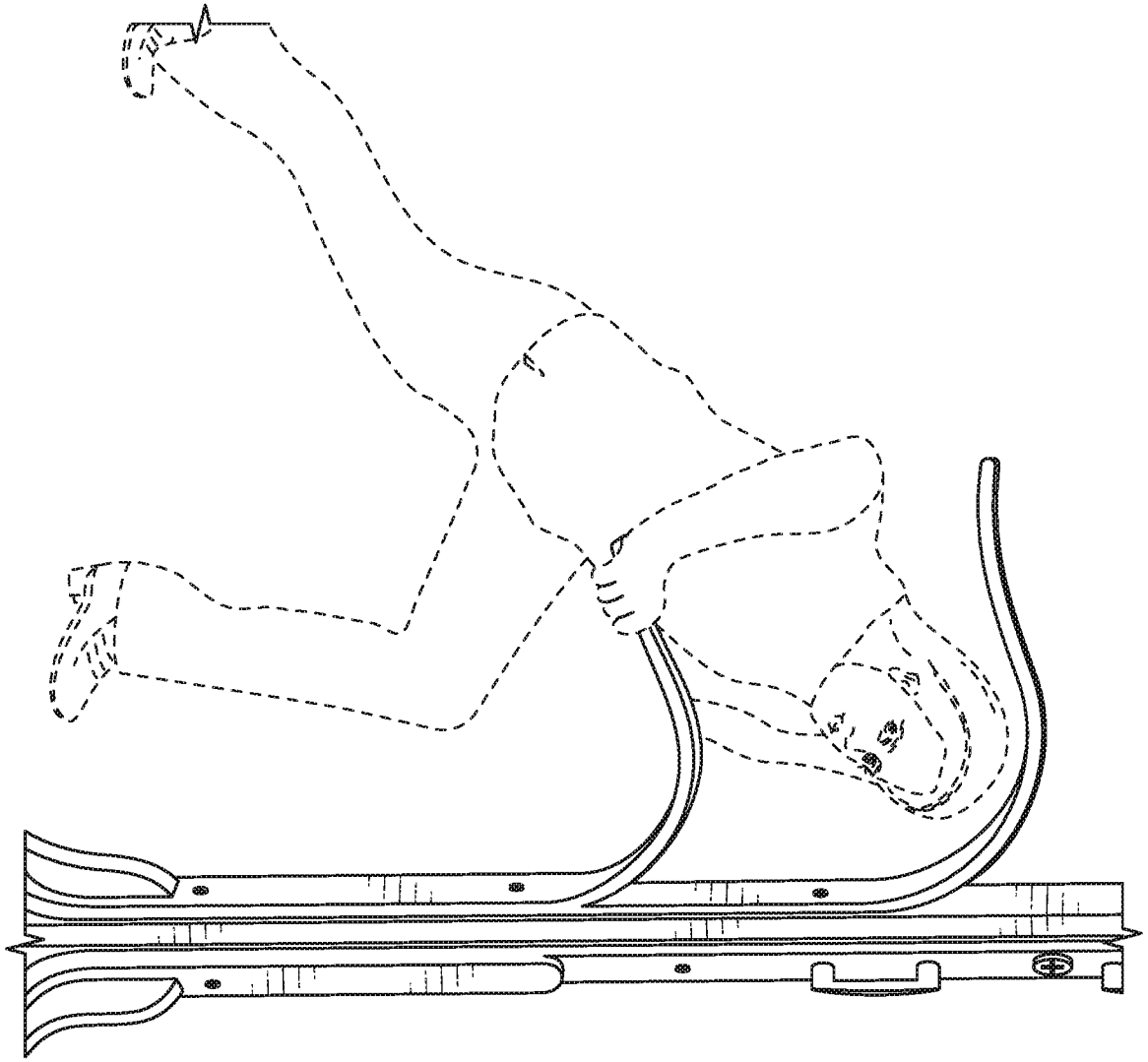
Figure 26:
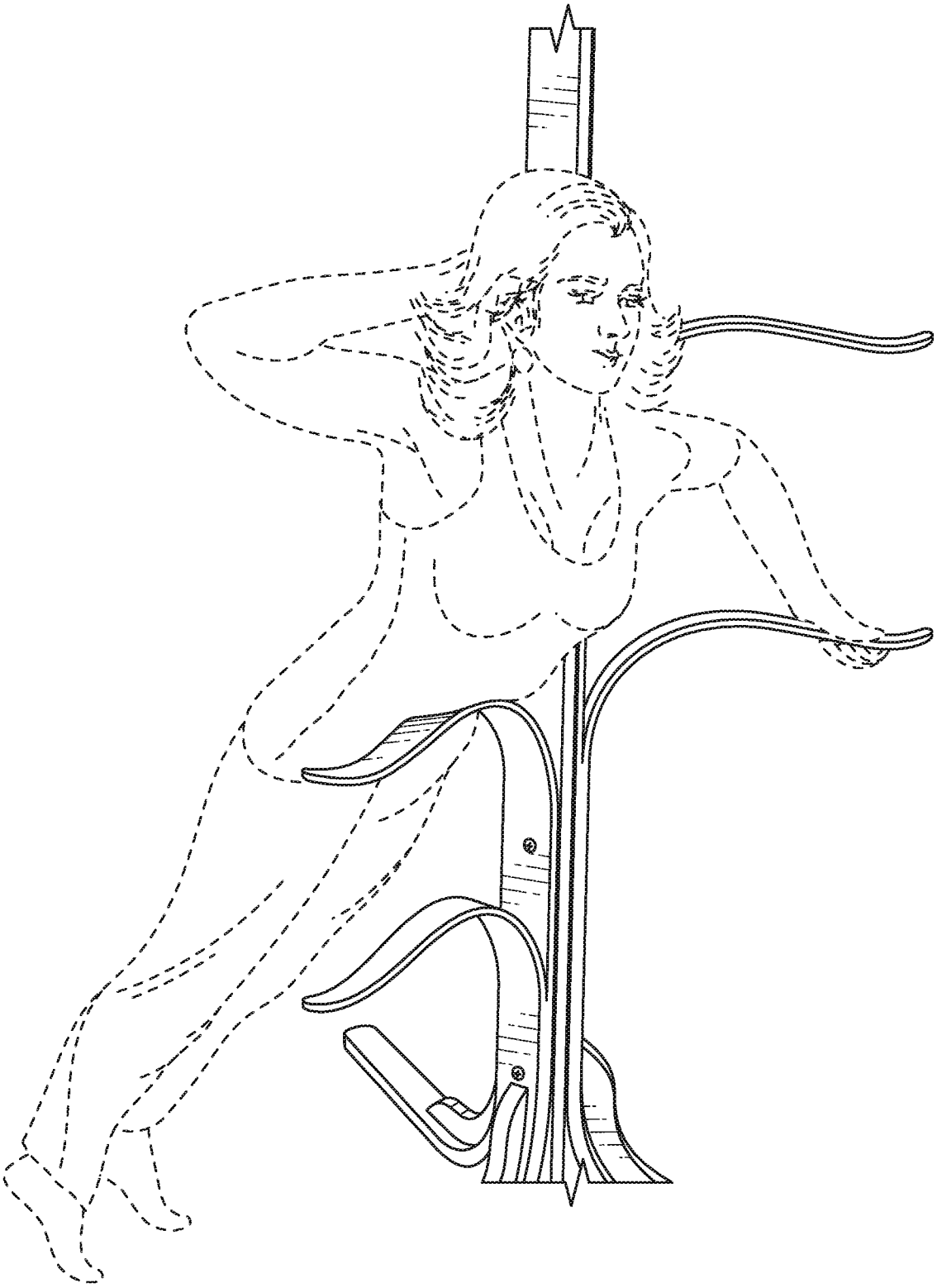
Figure 27:
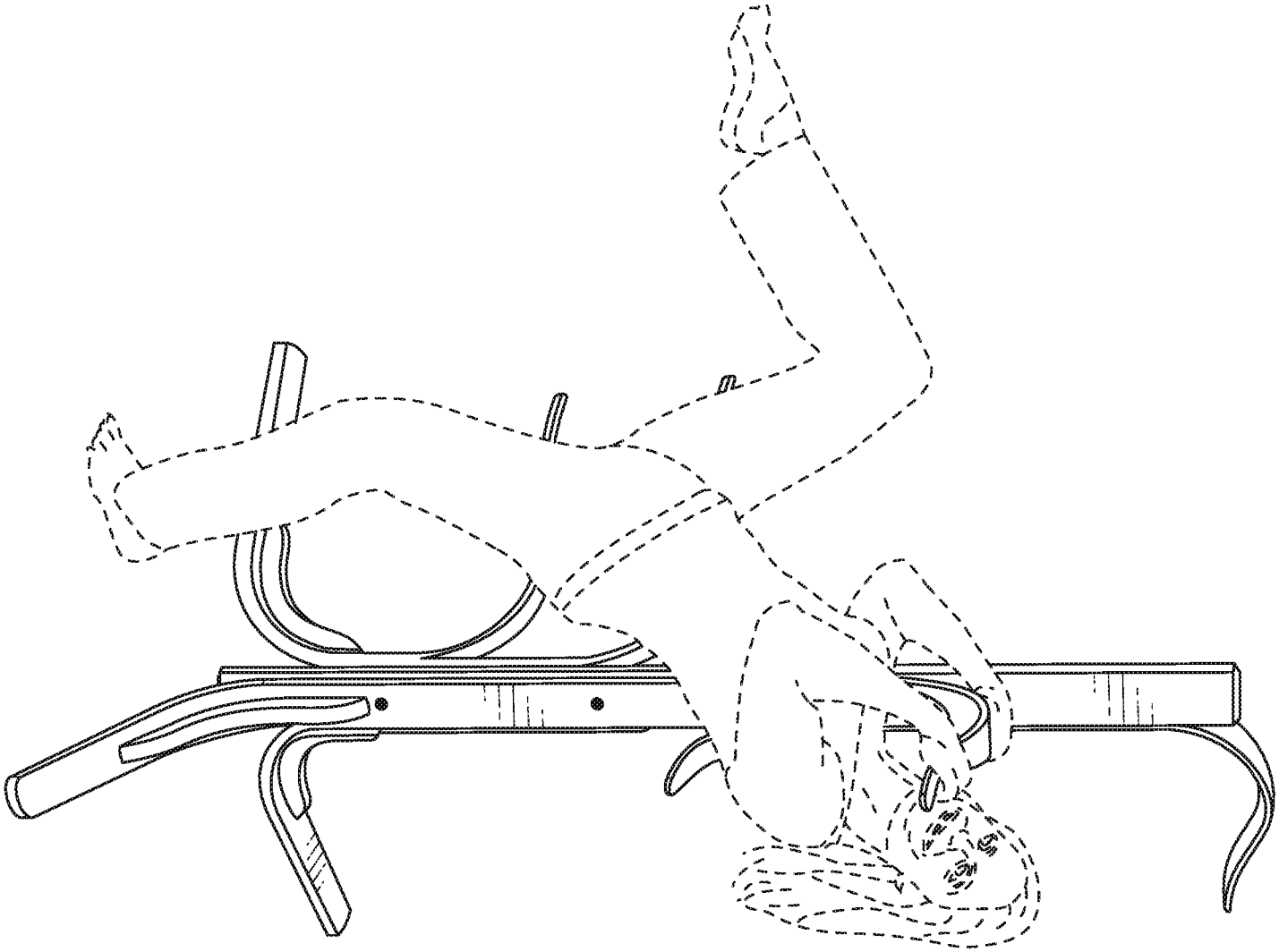
Figure 28:
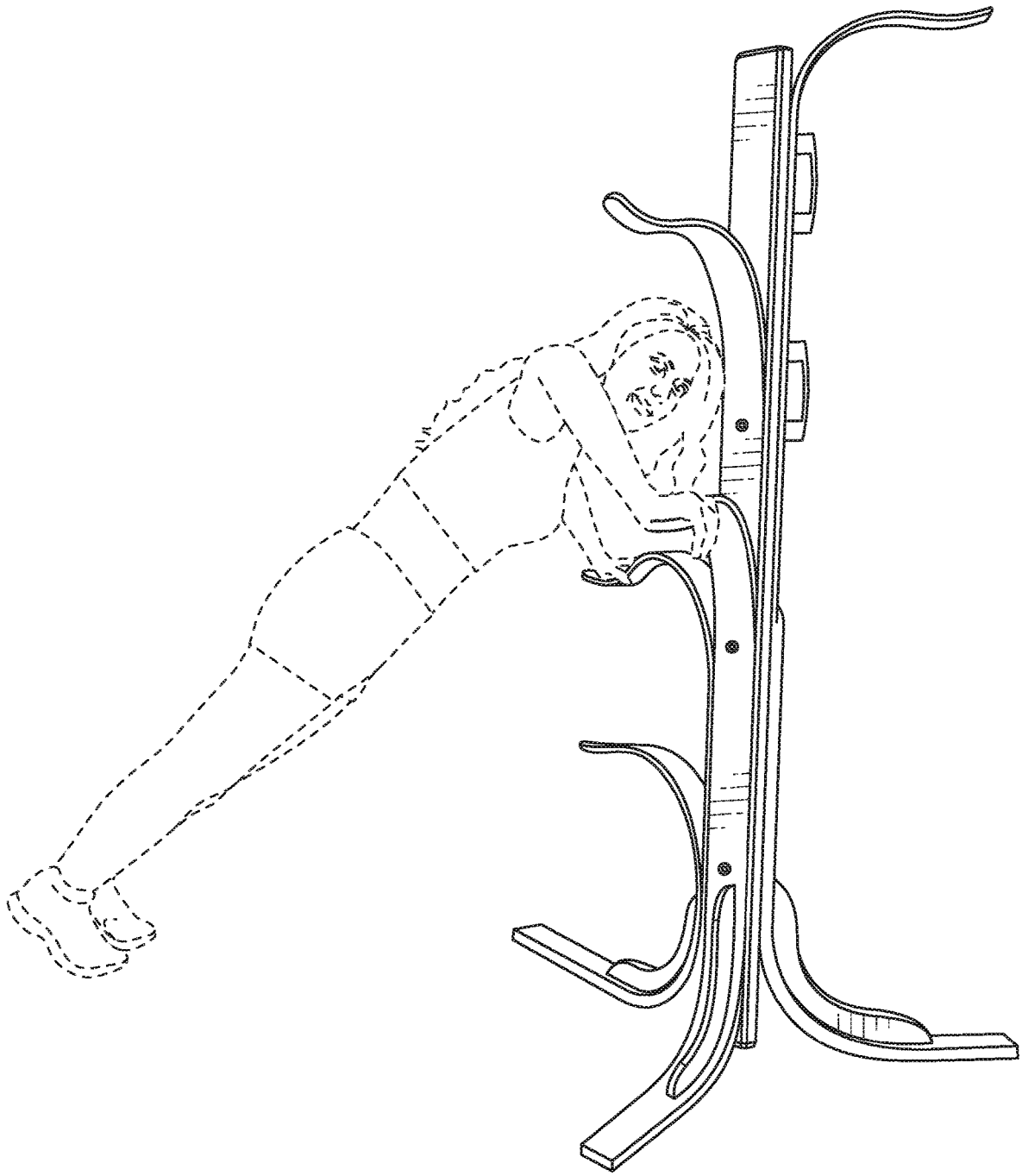
Figure 29:
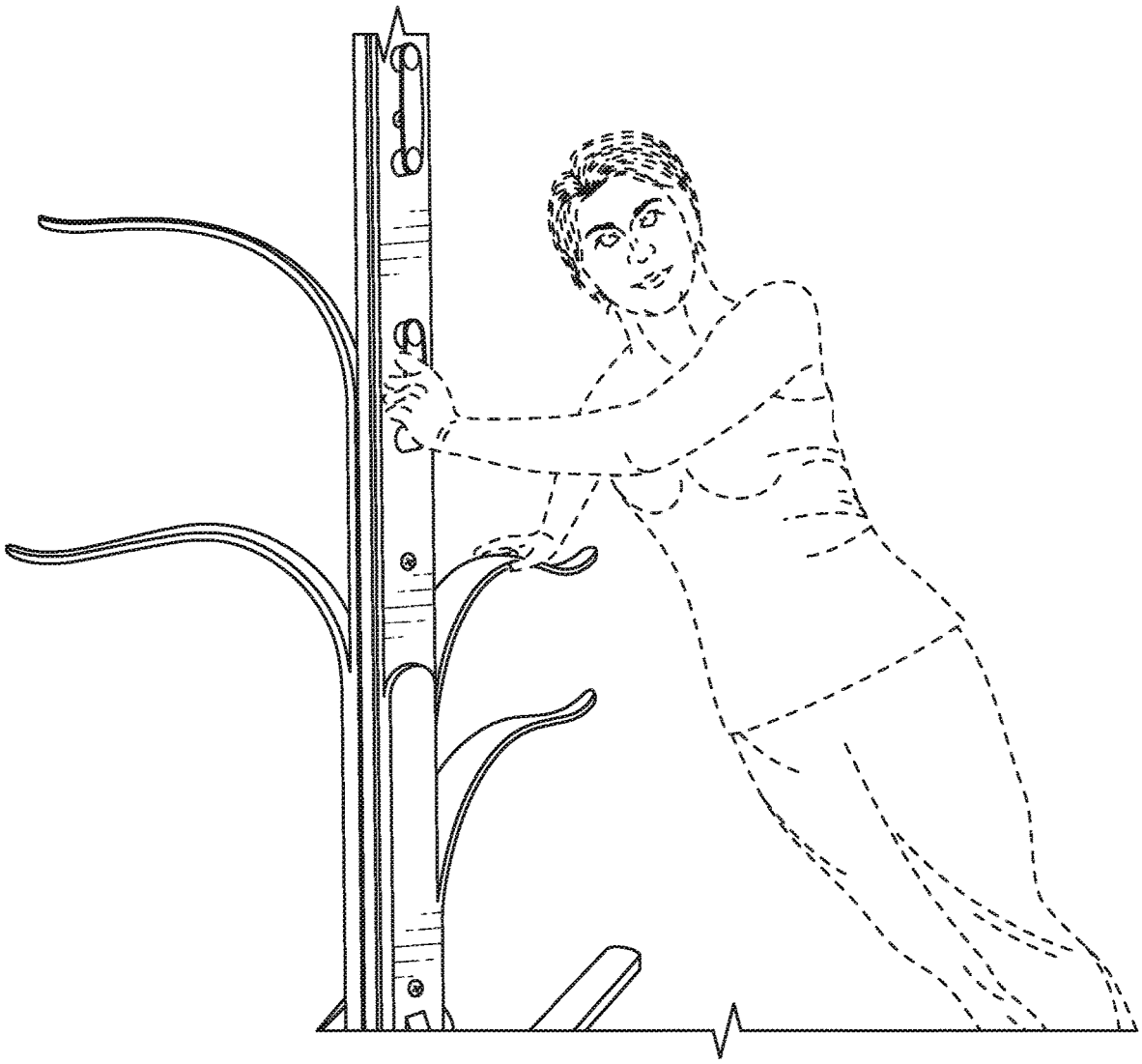
Figure 30:
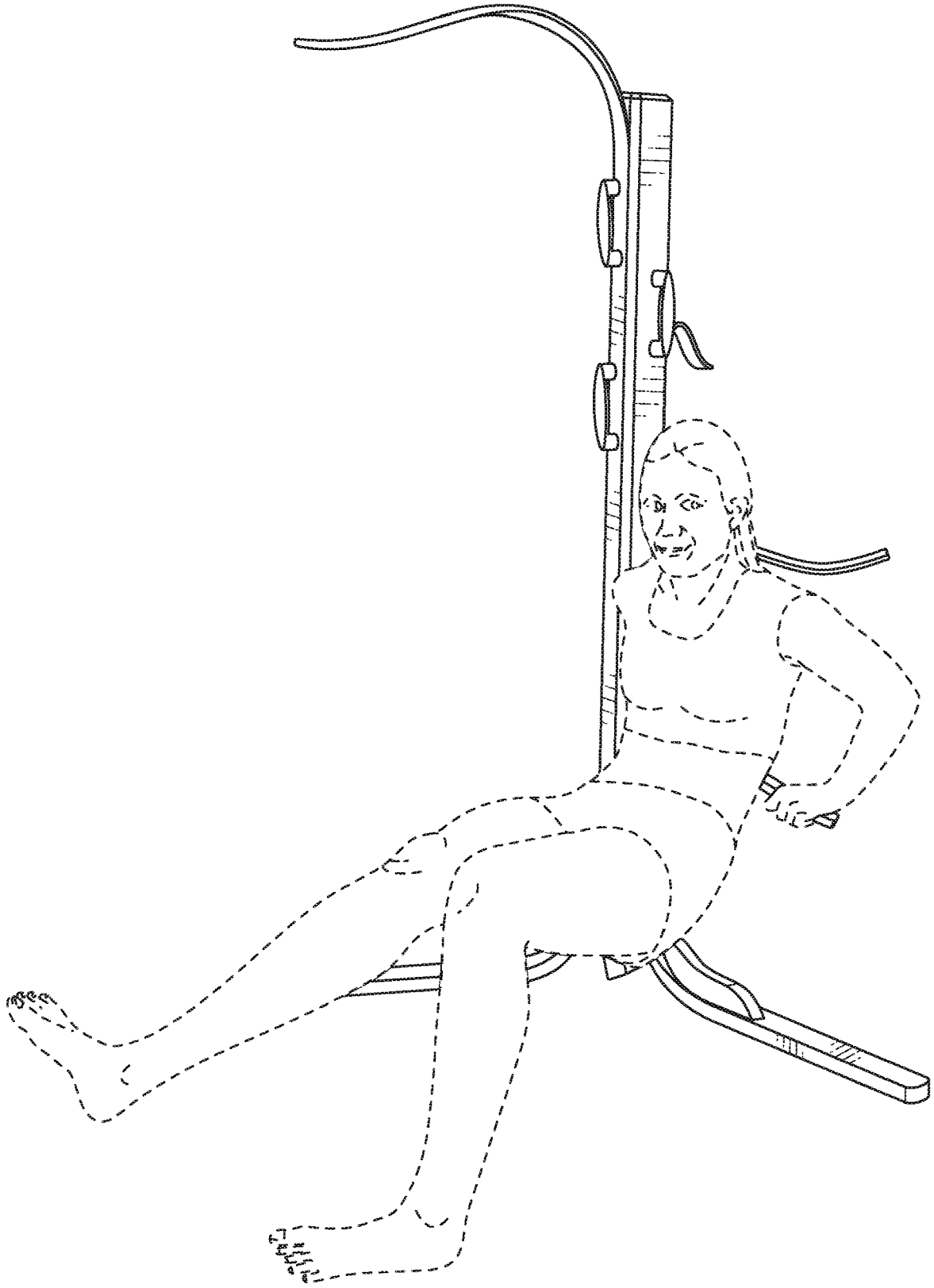
Figure 31:
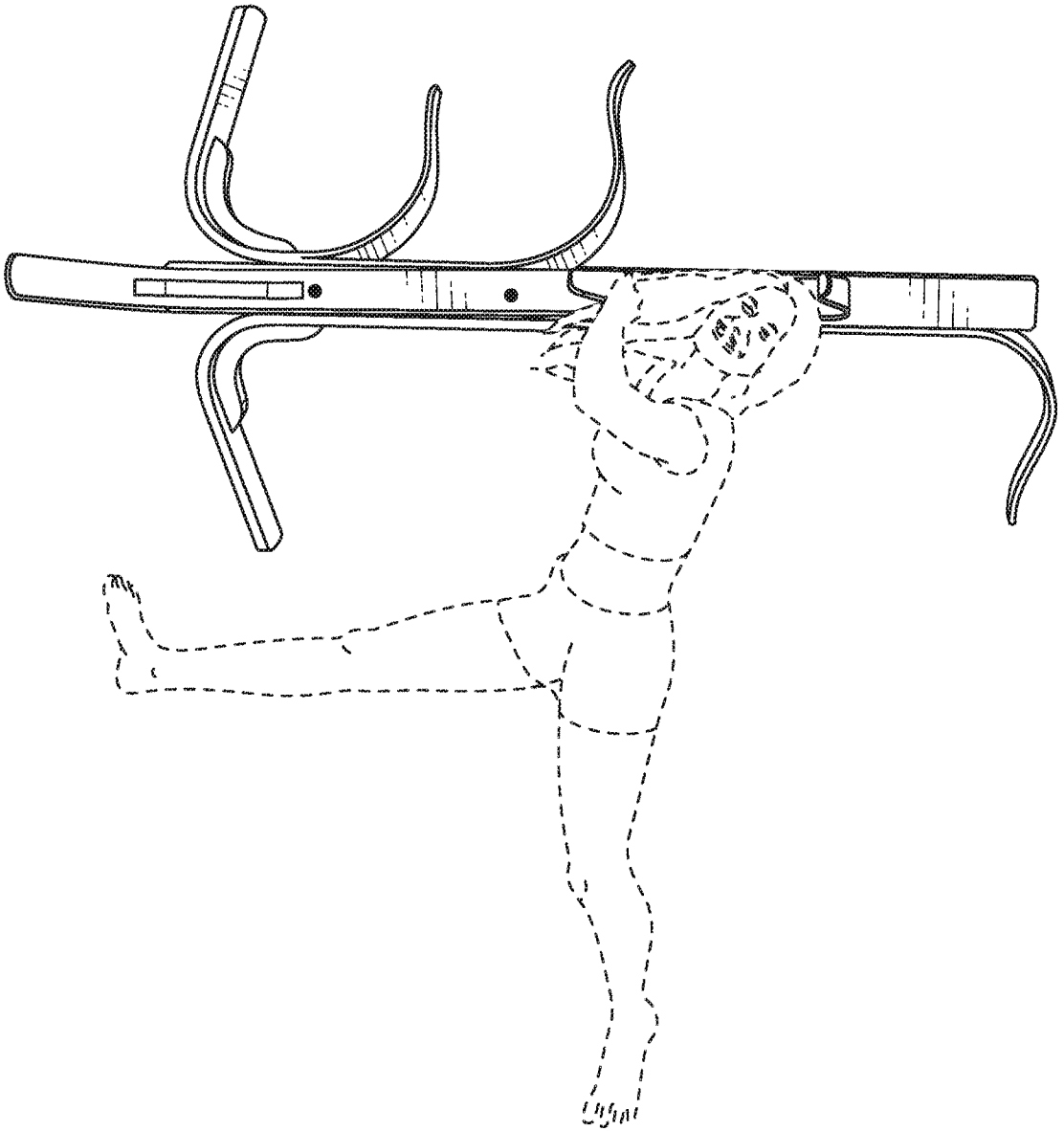
Figure 32:
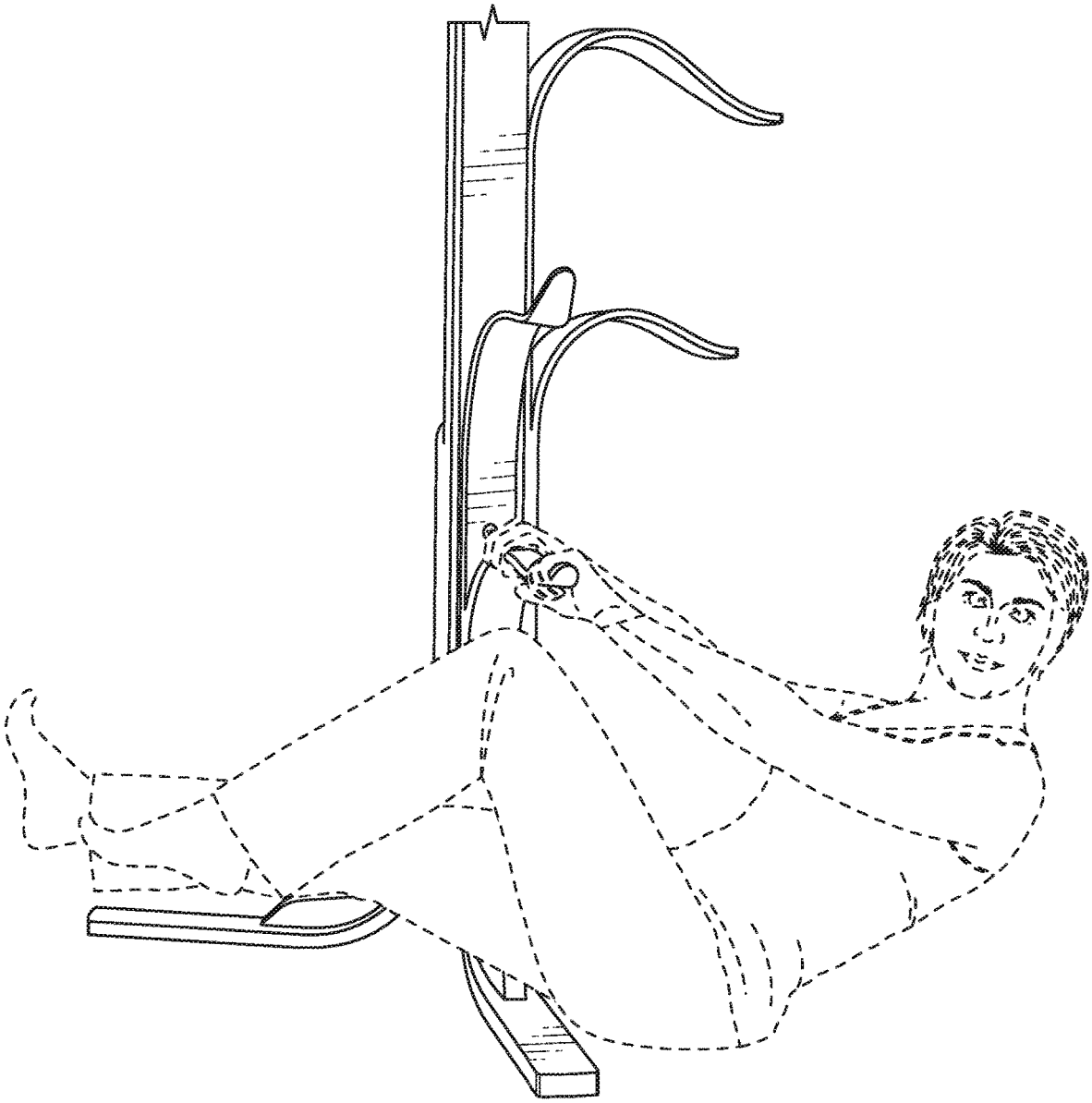
Figure 33:
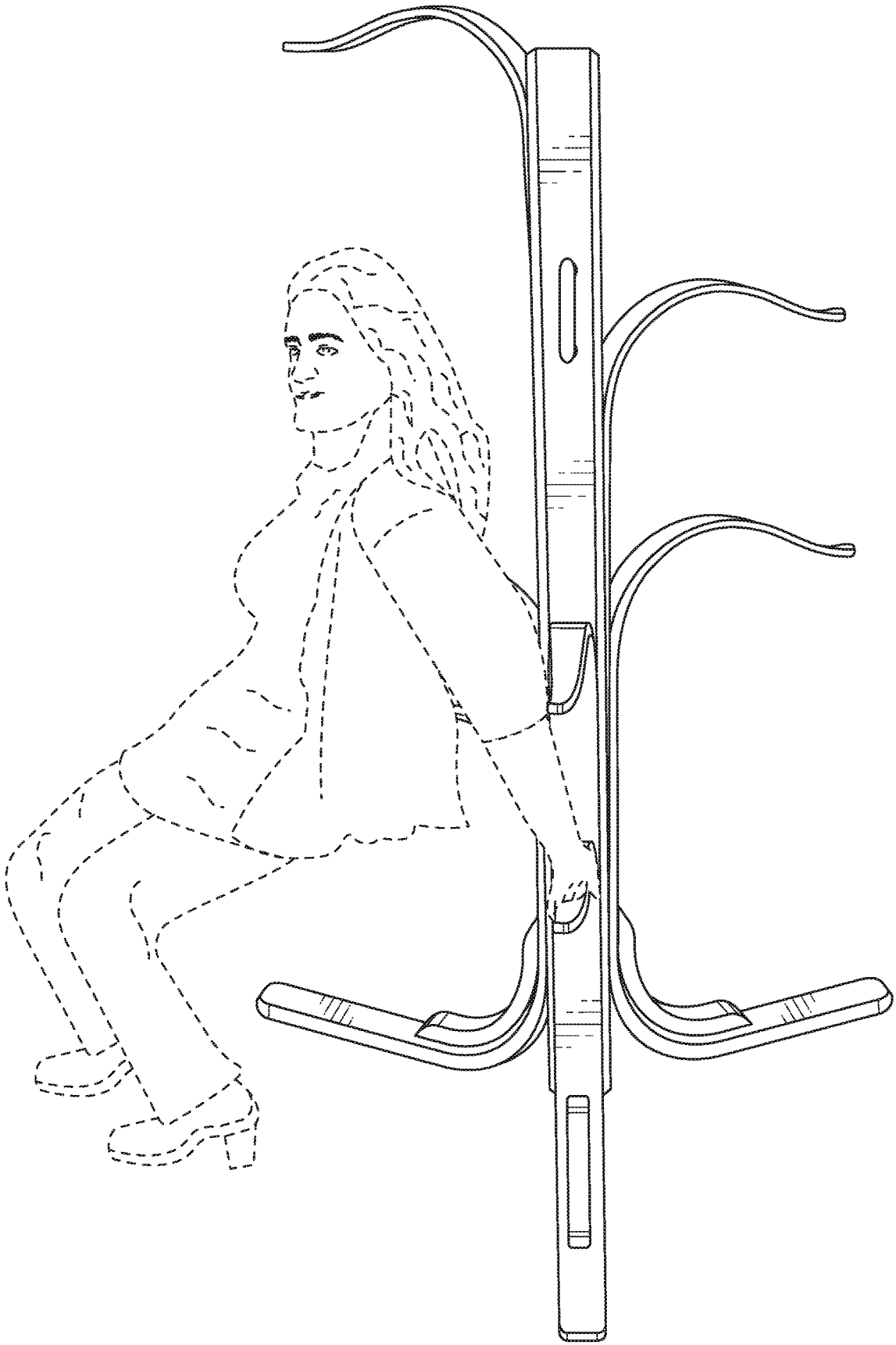
Figure 34:
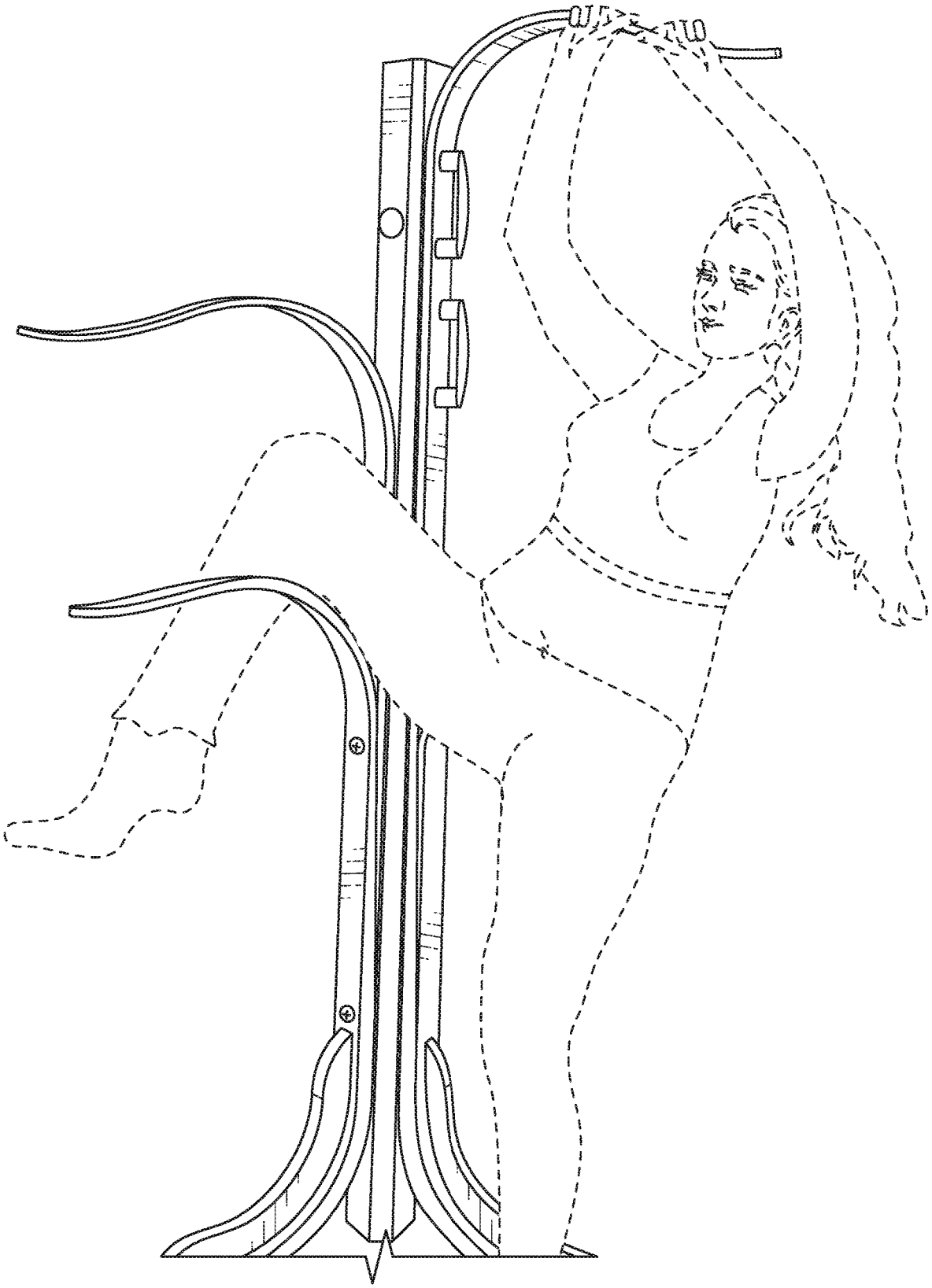

FIGS. 6-7 illustrate the triangular arrangement of the central post walls 101, which as mentioned can be discrete components or integral parts of a unitary piece. FIGS. 6-7 also illustrate the tripod arrangement of the roots 104 and of the various branches.

FIGS. 8-21 illustrate various modes of using the apparatus 100 for stretches. The apparatus 100 admits of unlimited user positions. For example, a low hamstring stretch can be accomplished by one resting one heel on the lower limb 112 while grasping one of the handles 116; alternatively, a high hamstring stretch can be accomplished by one resting one heel on either of the mid-body branches 108, 110 while gripping one of the handles 116; or by one resting a heel on the upper branch 106 while also gripping the upper branch 106. A glutes stretch can be accomplished by one placing the ball or arch of their foot on the lower limb 112 while also gripping the mid-body branch 110 to establish a forward-leaning posture; or by one gripping the upper branch 106 and the mid branch 108 while lunging forward to place one's shoulders at about the level of the mid branch 108. A shoulder stretch can be accomplished by one gripping the hanging branch 114 with one hand while facing away from the central post 102, reaching back with the other hand to grip one of the mid branches 108, 110. A full body stretch (back bend) can be accomplished by one gripping one of the handles 116 beneath the hanging branch 114, while facing away from the central post 102 and bending backward. Equally, a full body stretch also can be accomplished by one leaning backwards over the mid branch 110 while reaching around the central post 102 to grip the upper branch 106.

FIGS. 22-34 illustrate various modes of using the apparatus 100 for isometric (resistance) training. For example, the hanging branch 114 can be used for one-handed or two-handed pull ups or chin ups, or can be pulled downward by a heavier user for an arm exercise. The mid branches 108, 110 can be used for standing pushups or supported lunges. The upper branch 106 and the mid branch 108 can be worked together for arm extensions and shoulder work. The lower branch 110 also can be used for dips.

Other modes of use are apparent to the ordinary skilled worker from review of FIGS. 8-34. Generally, the apparatus 100 provides for modes of physical exercise that include approaching the apparatus 100; engaging one's first appendage with a first branch of the apparatus; exerting at least a portion of one's body weight onto the first branch of the apparatus via one's first appendage; and adjusting a position of one's first appendage along the first branch of the apparatus, in order to obtain a desired range of movement of one's first appendage. For example, the first appendage may be one's arm. The mode of exercise also may include gripping a handle of the apparatus with one's second appendage, and exerting a portion of one's body weight on the handle via one's second appendage wherein the second appendage is one's hand. Alternatively, one may engage one's second appendage with the first or a second branch of the apparatus, then shift a portion of one's body weight from one's first appendage to one's second appendage, wherein the second appendage is one's leg.

Figure 35:
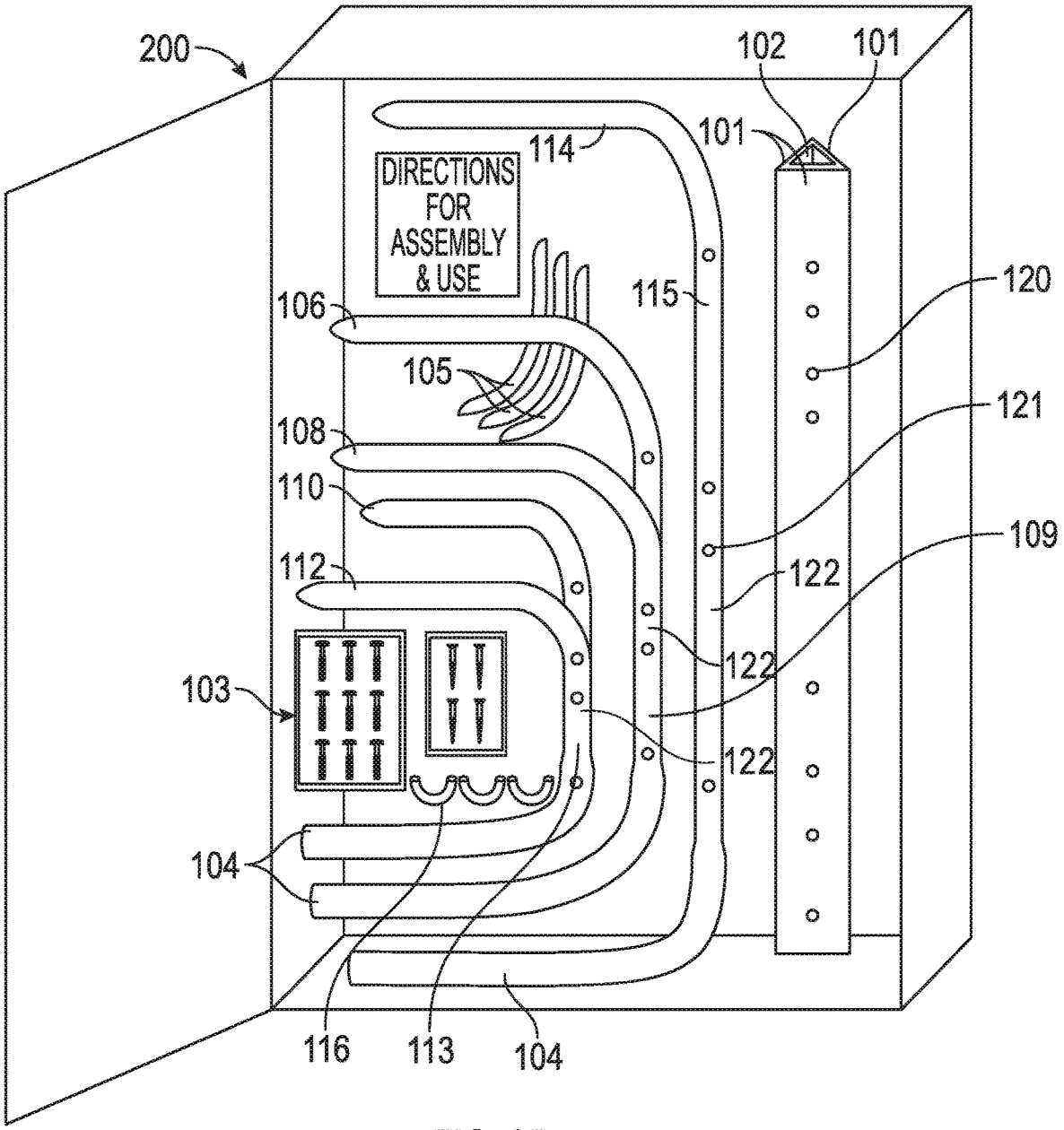
FIG. 35 illustrates a mode of packing the apparatus.

FIG. 35 illustrates a mode of packaging the apparatus 100 within a shipping carton 200. As can be seen, the walls 101 of the central post 102 include pre-formed holes 120, to which pre-formed holes 121 of the several limbs 109, 113, 115 can be aligned in order to assemble the limbs to the post 102 and erect the apparatus 100 using the fasteners 103. Thus, within the shipping carton 200, the post 102 is packaged along with the at least three limbs 109, 113, 115. Each of the limbs 109, 113, or 115 comprises a stem 122 with first and second ends, at least one branch 106, 110 or 114 protruding from the first end of the stem 122, and a root 104 protruding from the second end of the stem 122. The shipping carton 200 also contains fasteners 103 for attaching the at least three limbs to the post. The post 102 includes preformed sites 120 for installation of the fasteners to attach the at least three limbs; the stems 122 of the at least three limbs include preformed holes 121 for installation of the fasteners; and the preformed sites are distributed about the post and the preformed holes are disposed in the stems 122 of the at least three limbs, in such a manner that the limbs when attached to the post have their at least three roots protruding in differing directions from a base of the post to support the post in an upright position, and have their at least three branches protruding in differing directions and at differing heights from the post. At least one of the at least three limbs, e.g. a first of the limbs 109 or a second of the limbs 113, includes an additional branch 108 or 112 that protrudes from the stem 122 between the first and second ends. The shipping carton 200 further contains at least one handle 116, and the post 102 includes preformed sites 120 for attachment of the at least one handle.

Although exemplary embodiments of the invention have been described with reference to attached drawings, those skilled in the art nevertheless will apprehend variations in form or detail that are consistent with the scope of the invention as defined by the appended claims.

What is claimed is:

1. An apparatus for physical exercise, comprising:

a central post;

at least three roots protruding generally horizontally in differing directions from a base of the central post; and at least three branches protruding generally horizontally from the central post at differing heights and in differing directions, wherein each of the at least three branches is formed as a contiguous part of a respective limb that also includes a respective one of the at least three roots, and wherein the at least three branches are composed of fibrous material with the fibers oriented generally along the lengths of the branches.

2. The apparatus of claim 1, further comprising at least one handle fastened to the central post at a height among the at least three branches.

3. The apparatus of claim 1, further comprising at least one additional branch that protrudes generally horizontally from the central post in a same direction as one of the at least three branches but at a different height as said one branch.

4. The apparatus of claim 1, wherein each of the at least three branches protrudes in a same direction as a respective one of the at least three roots.

5. The apparatus of claim 1, wherein each of the at least three limbs is removably fastened to the central post at a stem portion of the limb that connects the respective branch and root to one another.

6. The apparatus of claim 1, wherein the at least three roots protrude from the post with substantially uniform angular spacing.

7. The apparatus of claim 1, wherein the fibrous material is wood.

8. The apparatus of claim 1, wherein the central post is triangular tubular in cross-section.

9. The apparatus of claim 8, wherein the central post is formed of three boards connected edge-to-flat, and each of the at least three limbs is removably fastened to the flat side of one of the three boards of the post at a stem portion of the limb that connects the respective branch and root to one another.

* * * * *